US007987797B2

(12) United States Patent
Stahl et al.

(10) Patent No.: US 7,987,797 B2
(45) Date of Patent: Aug. 2, 2011

(54) STACKABLE PACKAGED GOODS PALLET

(75) Inventors: Edward L. Stahl, Tyler, TX (US); Stanley Charles Ellington, Trussvile, AL (US); Brent Clyde Mizell, Pinson, AL (US); Travis Truman Crane, Morris, AL (US); Ira Donavan Youmans, Jr., Evans, GA (US); John P. Barry, Alpharetta, GA (US)

(73) Assignee: Coca-Cola Bottling Co. United, Inc., Birmingham, AL (US)

( * ) Notice: Subject to any disclaimer, the term of this patent is extended or adjusted under 35 U.S.C. 154(b) by 0 days.

(21) Appl. No.: 12/755,682

(22) Filed: Apr. 7, 2010

(65) Prior Publication Data

US 2010/0196134 A1 Aug. 5, 2010

Related U.S. Application Data

(63) Continuation of application No. 11/615,635, filed on Dec. 22, 2006, now abandoned.

(51) Int. Cl.
*B65D 19/38* (2006.01)

(52) U.S. Cl. ..... 108/53.3

(58) Field of Classification Search ..... 108/53.1, 108/53.3, 55.1, 57.25, 57.26, 57.27, 57.28, 108/57.29

See application file for complete search history.

(56) References Cited

U.S. PATENT DOCUMENTS

| | | | | |
|---|---|---|---|---|
| 1,963,360 | A * | 6/1934 | Gibbin et al. | 15/167.1 |
| 3,598,065 | A * | 8/1971 | Young | 108/3 |
| 3,611,952 | A * | 10/1971 | Hoffman | 108/11 |
| 3,699,901 | A * | 10/1972 | Cook, III | 108/57.25 |
| 4,061,090 | A * | 12/1977 | Callon | 108/57.16 |
| 4,865,202 | A * | 9/1989 | Day | 206/597 |
| 5,676,064 | A * | 10/1997 | Shuert | 108/57.25 |
| 5,755,162 | A * | 5/1998 | Knight et al. | 108/53.1 |
| 6,312,208 | B1 * | 11/2001 | Crowley et al. | 414/398 |
| 6,357,366 | B1 * | 3/2002 | Frankenberg | 108/57.25 |
| D464,186 | S * | 10/2002 | Medoff et al. | D34/38 |
| 6,530,476 | B1 * | 3/2003 | Overholt | 206/386 |
| 6,718,888 | B2 * | 4/2004 | Muirhead | 108/57.25 |
| 2002/0017225 | A1 * | 2/2002 | Koefelda et al. | 108/53.3 |
| 2003/0019403 | A1 * | 1/2003 | Gruber et al. | 108/53.1 |
| 2006/0048687 | A1 * | 3/2006 | Quigley | 108/57.28 |

* cited by examiner

*Primary Examiner* — José V Chen
*Assistant Examiner* — Matthew W Ing
(74) *Attorney, Agent, or Firm* — Katten Muchin Rosenman, LLP

(57) ABSTRACT

A pallet for shipping and displaying of packaged goods wherein the pallet comprises a plurality of stacking feet joined together by angled ribs to substantially prevent or inhibit spreading of the stacking feet due to high weight loads, a plurality of handles that include handle-strengthening areas and finger recesses to increase the strength and lifting ergonomics of the pallet, and an angled surface on the bottom of the stacking feet to facilitate transporting of the loaded pallet from a distribution vehicle to a retail location over certain obstacles. Accordingly, the packaged goods can comprise beverage trays filled or partially filled with beverage bottles, or any good and/or raw material for sale and/or use in manufacturing.

52 Claims, 21 Drawing Sheets

STACKABLE PACKAGED GOODS PALLET

This application is a continuation of U.S. patent application Ser. No. 11/615,635, filed Dec. 22, 2006, the contents of which is incorporated herein by reference.

CROSS REFERENCE TO RELATED APPLICATIONS

Related subject matter is disclosed in co-pending U.S. Non-provisional patent application Ser. No. 11/615,677, entitled "A Pallet Jack System and Method for the Transportation of Stackable Packaged Goods Pallets", concurrently filed on Dec. 22, 2006, the entire contents of which are expressly incorporated herein by reference.

BACKGROUND OF THE INVENTION

1. Field of the Invention

The invention relates to stackable pallets. More particularly, the invention relates to a system and method for stacking packaged goods on a pallet and moving the same such that during transit, tipping and spillage of the packaged goods off the pallet is substantially reduced or eliminated.

2. Background Art

Consumers in the U.S., as is well known, purchase products for personal and home use from a variety of locations. These products include many different types of pre-packaged food items with significant shelf lives (breakfast cereals, cake mixes, snack foods, snack beverages, among many other items), personal care items (deodorants, toothpaste, shampoos, among many other items), as well home-use items such as paper towels, light bulbs, cleaning supplies (dishwashing detergents, washing machines detergent), among many other types. The types of stores where people purchase these items varies, and large nationally operated chain grocery stores (Shoppers®, Giant®, among others), nationally operated retail warehouse shopping stores (Wal-Mart®, Costco®, BJ's®, among others), and smaller convenience stores (7-11®, Wawa®, ExxonMart®, among others).

Even though a great variety of stores exist, consumers have become accustomed to purchasing whatever they want from wherever they want. That is, a consumer knows he or she can purchase, for example, beverage products (soft drinks), at any of the stores, the differentiation being perhaps price and size of containers. Manufacturers ship their goods to all these different types of stores, and they are generally shipped the same way: in cardboard boxes, loaded onto pallets.

The pallets used to ship all these different types of goods are loaded in central distribution warehouses. The loaded pallets are then placed into delivery vehicles, usually large wheel tractor trailers, and hauled to the different stores. Sometimes the entire loaded pallet is dropped off at the store, and the store's employees unload the pallets and stack the items onto shelves. Sometimes the drivers are responsible for unloading pallets and stacking shelves. Some items are not loaded onto pallets, but are loaded onto delivery vehicles, and then off-loaded from the delivery vehicle and stocked on shelves or point-of-purchase displays.

In the distribution chain described above, significant amounts of time and energy are devoted to the loading and subsequent unloading of pallets. Still further time and energy are devoted to the stocking of shelves of the shipped product. Although distribution of different products will vary, overall, it is about the same. The loading, unloading and shelving, or stacking of products costs hundred of millions of dollars each year through wages, and even worse, hundreds of millions, if not billions of dollars in lost employee time and workers' compensation claims due to back and repetitive stress injuries. Back and repetitive stress injuries cost significant money and negatively impairs employees' lives. Thus, the current mechanisms and methods for distribution of product (which can also extend in some instances to raw materials for manufacturing) has significant shortcomings that take a personal and economic toll on the lives of many people.

A particular example of a product that is distributed as described above are consumer soft drink beverages. People throughout the world consume vast quantities of beverages, commonly referred to as "soft drinks", and thus the soft drink industry is an extremely large one, wherein several billion dollars are spent annually. A significant portion of the people purchase soft drinks from restaurants of all different types, and others obtain their beverages from large retail stores, such as grocery stores or large discount stores (such as BJs®, Wal-Mart®, among others), yet a significant portion of the retail market also obtains their soft drink beverages from convenience stores.

FIG. 1 illustrates a type of device, commonly referred to as a dolly, that is used to transport many different types of products, including soft drinks. When soft drink product is distributed to grocery and convenience stores (retail location), it is generally placed on the distribution or delivery vehicle onto racks. The drivers or operators of the vehicles then unload the soft drink product at the retail location onto a dolly as shown in FIG. 1. Then, the operator transports the loaded dolly, which can weigh about 250 lbs., into the retail location. Often times the parking lot is a gravel or dirt parking lot, or is paved, but the asphalt has large cracks and/or "potholes". The gravel, cracks, and/or potholes can cause operators to lose control of the loaded dolly, or make it difficult to keep control of the loaded dolly, which can lead to tipping and/or spillage of the product. Generally, the operator must also lift the loaded pallet up a curb from the parking lot to the sidewalk or entrance to the retail location. All these actions—loading, unloading, transport, lifting, and then shelving or stacking the product, consumes significant amounts of energy and time, and leads to the back and repetitive stress injuries discussed above.

Thus, a need exists for a pallet that transport and displays packaged goods that substantially eliminates or reduces the material and physical costs of distribution of product, and furthermore, substantially prevents or eliminates tipping and spillage of product while being shipped and transported.

SUMMARY OF THE INVENTION

It is therefore a general object of the invention to provide a packaged goods pallet that will obviate or minimize problems of the type previously described.

It is a specific object of the invention to provide a packaged goods pallet that can be stacked upon another like, similar container.

It is an object of the present invention to provide a packaged goods pallet that can be stacked upon another like, similar container in a 0° and 180° stacking orientation.

It is an object of the present invention to provide a packaged goods pallet that substantially prevents containers and/or trays from sliding off of the packaged goods pallet when stored thereon during shipping.

It is an object of the present invention to provide a packaged goods pallet that includes a ledge on two opposing side walls to substantially prevent containers and/or trays filled with product from sliding off the packaged goods pallet stored thereon during shipping.

It is an object of the present invention to provide a packaged goods pallet that contains a plurality of means for strengthening the pallet such that greater quantities and weights of products can be shipped.

It is an object of the present invention to provide a packaged goods pallet that includes a plurality of V-shaped ribs to provide increased tensile strength between a plurality of stacking feet such that greater quantities and weights of products can be shipped.

It is an object of the present invention to provide a packaged goods pallet that includes a first plurality of strengthening ribs located between a plurality of stacking feet and a second plurality of strengthening ribs located along an outer perimeter area of the pallet, wherein the first set of strengthening ribs are taller than the second set of strengthening ribs thereby allowing greater quantities and weights of products to be shipped on the pallet.

It is an object of the present invention to provide a packaged goods pallet that includes a plurality of handle strengthening areas that includes one or more strengthening ridges thereby allowing greater quantities and weights of products to be shipped on the pallet.

It is an object of the present invention to provide a packaged goods pallet that provides a means for a user to substantially easily remove an upper container off a lower like or similar container.

It is an object of the present invention to provide a packaged goods pallet that includes a plurality of finger recesses on an inner wall located near one or more of a plurality of handles thereby allowing a user to substantially easily remove an upper container off a lower like or similar container.

It is an object of the present invention to provide a packaged goods pallet that includes a plurality of finger recesses on an outer wall located near one or more of a plurality of handles thereby allowing a user to substantially easily remove an upper container off a lower like or similar container.

It is an object of the present invention to provide a packaged goods pallet that includes a plurality of inner ribs on an interior portion of a plurality of stacking feet thereby substantially preventing an upper pallet from wedging into a lower pallet when stacked in either a 0° or a 180° stacking orientation thereby allowing a user to substantially easily remove an upper container off a lower like or similar container.

It is an object of the present invention to provide a packaged goods pallet that allows a user to substantially easily traverse a ramp from a first surface to a second surface, at a proscribed angle, with little or no impedance.

It is an object of the present invention to provide a packaged goods pallet that includes a plurality of angled surfaces on a plurality of stacking feet such that the pallet can substantially easily traverse a ramp from a first surface to a second surface, at a proscribed angle, with little or no impedance.

The above described disadvantages are overcome and a number of advantages are realized by a first aspect of the present invention which relates to a pallet for use in transporting packaged goods, comprising: a front side wall, a right side wall, a rear side wall and a left side wall, the pallet having a central longitudinal axis running from the left side wall to the right side wall; a base configured to support the packaged goods, the base being joined to each of the front side wall, right side wall, rear side wall, and left side wall such that each side wall is orthogonal to the base, the base including an upper surface and a lower surface, the upper surface being substantially planar, and the lower surface including a first set of ribs substantially perpendicular and adjacent to the central longitudinal axis of the pallet; and a plurality of pairs of stacking feet configured to support the base of the pallet, wherein each stacking foot in each pair of stacking feet is substantially equidistant from the central longitudinal axis of the pallet, and further wherein, each rib in the first set of ribs is configured to join a respective pair of stacking feet together to substantially inhibit the respective pair of stacking feet from spreading when the pallet rests upon the stacking feet.

According to the first aspect of the present invention, for each pair of stacking feet, a first stacking foot is located on a first side of the central longitudinal axis, and a second stacking foot is located on a second side of the central longitudinal axis, and wherein, the first stacking foot and the second stacking foot are each located substantially equi-distant from the central longitudinal axis of the pallet. According to the first aspect of the present invention the first set of ribs comprises: a plurality of substantially V-shaped ribs, wherein each of the substantially V-shaped ribs forms a V-shaped angle, and further wherein the V-shaped angle formed by each of the substantially V-shaped ribs measures between about 70° and about 110°. According to the first aspect of the present invention the V-shaped angle formed by each of the substantially V-shaped ribs measures between about 80° and about 100°, and further wherein the V-shaped angle formed by each of the substantially V-shaped ribs measures about 90°.

According to the first aspect of the present invention the plurality of pairs of stacking feet comprises three pairs of stacking feet, and the first aspect further comprises a plurality of handles configured to enable a user to grasp the pallet, wherein each of the handles is positioned on the base. The plurality of handles in the first aspect comprises: a left side wall handle located adjacent to the left side wall and wherein the left side wall handle is substantially symmetrically placed about the central longitudinal axis; a right side wall handle located adjacent to the right side wall and wherein the right side wall handle is substantially symmetrically placed about the central longitudinal axis; a pair of front side wall handles located adjacent to the front side wall; and a pair of rear side wall handles located adjacent to the rear side wall, wherein, each handle in each of the pair of front side wall handles and rear side wall handles are located substantially equidistant from an orthogonal longitudinal axis, wherein, the orthogonal longitudinal axis is substantially perpendicular to the central longitudinal axis, and is substantially equidistant from the left side wall and the right side wall.

According to the first aspect of the present invention each of the left side wall handles and the right side wall handles comprises: a plurality of handle strengthening ribs configured to strengthen the left side wall and right side wall respectively, and wherein each of the left side wall handle and right side wall handle further comprises: a plurality of finger recesses located on the left side wall and right side wall, respectively. The first aspect further comprises a left ledge located on the upper surface of the base over the left side wall; and a right ledge located on the upper surface of the base over the right side wall, wherein, the right ledge and the left ledge are configured to substantially prevent one or more of the packaged goods from sliding off the pallet. Each of the left ledge and the right ledge comprises: a raised portion of the upper surface of the base in a semi-circular shape with a radius between about 0.120 and about 0.6 inches, and wherein each of the left ledge and the right ledge comprises: a raised portion of the upper surface of the base in a semi-circular shape with a radius of about 0.5 inches. According to the first aspect of the present invention the packaged goods comprise a plurality of beverage trays, and each of the plurality of beverage trays is filled with one or more beverage bottles.

The first aspect of the present invention further comprises: one or more recesses located on the upper surface of the base;

and a tacky material positioned within the one or more recesses, wherein the tacky material is configured to substantially prevent one or more of the packaged goods from sliding off the pallet.

A second aspect of the present invention provides a pallet for use in transporting packaged goods, comprising: a front side wall, a right side wall, a rear side wall and a left side wall, the pallet having a central longitudinal axis running from the left side wall to the right side wall; a base configured to support the packaged goods, the base being joined to each of the front side wall, right side wall, rear side wall, and left side wall such that each side wall is orthogonal to the base, the base including an upper surface and a lower surface, the upper surface being substantially planar, and the lower surface including a first set of ribs substantially perpendicular and adjacent to the central longitudinal axis of the pallet; and a plurality of pairs of stacking feet configured to support the base of the pallet, wherein a first pair of stacking feet are located adjacent the left side wall, a second pair of stacking feet are located adjacent the right side wall, and a third pair of stacking feet are located between the first pair of stacking feet and second pair of stacking feet, and wherein each of the stacking feet in the first pair of stacking feet includes a substantially horizontal floor portion and an angled portion originating from the substantially horizontal floor portion, and wherein, the angled portion is formed at an angle in the range of about 5° to about 20° with respect to a plane of the substantially horizontal portion of the first pair of stacking feet, such that a plane of the angled portion of the first pair of stacking feet intersects a plane of the base of the pallet, and further wherein each of the stacking feet in the second pair of stacking feet includes a substantially horizontal floor portion and an angled portion originating from the substantially horizontal floor portion, wherein, the angled portion is formed at an angle in the range of about 10° to about 20° with respect to a plane of the substantially horizontal portion of the second pair of stacking feet, such that a plane of the angled portion of the second pair of stacking feet intersects a plane of the base of the pallet, and further wherein, the angled portions of each of the first pair of stacking feet and second stacking feet are configured to enable the pallet to be transported over an inclined ramp without substantially interfering with the inclined ramp.

According to the second aspect of the present invention the inclined ramp is placed between a street, and an uppermost portion of a curb alongside the street, and further wherein the angled portion of both the first pair of stacking feet and second pair of stacking feet is formed at an angle of about 15°. According to the second aspect of the present invention the packaged goods comprise a plurality of beverage trays, and wherein each of the plurality of beverage trays is filled with one or more beverage bottles.

The second aspect of the present invention further comprises a plurality of handles configured to enable a user to grasp the pallet, wherein each of the handles is positioned on the base, and wherein the plurality of handles comprises: a left side wall handle located adjacent to the left side wall and wherein the left side wall handle is substantially symmetrically placed about the central longitudinal axis; a right side wall handle located adjacent to the right side wall and wherein the right side wall handle is substantially symmetrically placed about the central longitudinal axis; a pair of front side wall handles located adjacent to the front side wall; and a pair of rear side wall handles located adjacent to the rear side wall, wherein, each handle in each of the pair of front side wall handles and rear side wall handles are located substantially equidistant from an orthogonal longitudinal axis, wherein, the orthogonal longitudinal axis is substantially perpendicular to the central longitudinal axis, and is substantially equidistant from the left side wall and the right side wall.

According to the second aspect of the present invention each of the left side wall handles and the right side wall handles comprises: a plurality of handle strengthening ribs configured to strengthen the left side wall and right side wall respectively, and wherein each of the left side wall handle and right side wall handle further comprises: a plurality of finger recesses located on the left side wall and right side wall, respectively.

The second aspect of the present invention further comprises a left ledge located on the upper surface of the base over the left side wall; and a right ledge located on the upper surface of the base over the right side wall, wherein, the right ledge and the left ledge are configured to substantially prevent one or more of the packaged goods from sliding off the pallet, and wherein each of the left ledge and the right ledge comprises: a raised portion of the upper surface of the base in a semi-circular shape with a radius between about 0.120 and about 0.6 inches.

According to the second aspect of the present invention each of the left ledge and the right ledge comprises: a raised portion of the upper surface of the base in a semi-circular shape with a radius of about 0.5 inches. According to the second aspect of the present invention the packaged goods comprise a plurality of beverage trays, and wherein each of the plurality of beverage trays is filled with one or more beverage bottles.

The second aspect of the present invention further comprises one or more recesses located on the upper surface of the base; and a tacky material positioned within the one or more recesses, wherein the tacky material is configured to substantially prevent one or more of the packaged goods from sliding off the pallet, and wherein each stacking foot in each pair of stacking feet comprises: an interior portion configured to accept a corresponding stacking foot from an upper, substantially similar pallet, when the upper, substantially similar pallet is stacked upon a lower pallet, and wherein the interior portion comprises a plurality of ribs configured to substantially prevent the corresponding stacking foot from the substantially similar upper pallet from becoming wedged into the interior portions of each corresponding stacking foot of the lower pallet, and further wherein, the ribs in the first pair of stacking feet and the second pair of stacking feet substantially support the substantially horizontal floor portion and the angled portion of each of the corresponding stacking feet of the upper substantially similar pallet, such that bending of the upper, substantially similar pallet is substantially prevented about the first pair of stacking feet and second pair of stacking feet of the upper, substantially similar pallet, thereby substantially preventing premature failure of the upper, substantially similar pallet.

A third aspect of the present invention provides a pallet for use in transporting packaged goods, comprising: a front side wall, a right side wall, a rear side wall and a left side wall, the pallet having a central longitudinal axis running from the left side wall to the right side wall; a base configured to support the packaged goods, the base being joined to each of the front side wall, right side wall, rear side wall, and left side wall such that each side wall is orthogonal to the base, the base including an upper surface and a lower surface, the upper surface being substantially planar, and the lower surface including a first set of ribs substantially perpendicular and adjacent to the central longitudinal axis of the pallet; and a plurality of pairs of stacking feet configured to support the base of the pallet, wherein each stacking foot in each pair of stacking feet is substantially equidistant from the central longitudinal axis of the pallet, thereby forming a set of front side wall stacking feet and a set of rear side wall stacking feet, and further wherein, the set of front side wall stacking feet are located at a predetermined distance from the front side wall, and the set of rear side wall stacking feet are located at a predetermined distance from the rear side wall, such that a first tine from a lifting device can be located adjacent the set of front side wall stacking feet, and a second tine from a lifting device can be located adjacent the set of rear side wall stacking feet, such that each of the first tine and the second tine is substantially parallel to the central longitudinal axis of the pallet, thereby further enabling the pallet to be lifted by the first and second tines.

According to the third aspect of the present invention the location of the first and second tines when the pallet is lifted enables the pallet to be transported with substantial stability when loaded with the packaged goods.

The third aspect of the present invention further comprises a plurality of handles configured to enable a user to grasp the pallet, wherein each of the handles is positioned on the base, and wherein the plurality of handles comprises: a left side wall handle located adjacent to the left side wall and wherein the left side wall handle is substantially symmetrically placed about the central longitudinal axis; a right side wall handle located adjacent to the right side wall and wherein the right side wall handle is substantially symmetrically placed about the central longitudinal axis; a pair of front side wall handles located adjacent to the front side wall; and a pair of rear side wall handles located adjacent to the rear side wall, wherein, each handle in each of the pair of front side wall handles and rear side wall handles are located substantially equidistant from an orthogonal longitudinal axis, wherein, the orthogonal longitudinal axis is substantially perpendicular to the central longitudinal axis, and is substantially equidistant from the left side wall and the right side wall.

According to the third aspect of the present invention each of the left side wall handles and the right side wall handles comprises: a plurality of handle strengthening ribs configured to strengthen the left side wall and right side wall respectively, and wherein each of the left side wall handle and right side wall handle further comprises: a plurality of finger recesses located on the left side wall and right side wall, respectively.

The third aspect of the present invention further comprises a left ledge located on the upper surface of the base over the left side wall; and a right ledge located on the upper surface of the base over the right side wall, wherein, the right ledge and the left ledge are configured to substantially prevent one or more of the packaged goods from sliding off the pallet, and wherein each of the left ledge and the right ledge comprises: a raised portion of the upper surface of the base in a semi-circular shape with a radius between about 0.120 and about 0.6 inches, and wherein each of the left ledge and the right ledge comprises: a raised portion of the upper surface of the base in a semi-circular shape with a radius of about 0.5 inches.

According to the third aspect of the present invention the packaged goods comprise a plurality of beverage trays, and each of the plurality of beverage trays is filled with one or more beverage bottles.

The third aspect of the present invention further comprising: one or more recesses located on the upper surface of the base; and a tacky material positioned within the one or more recesses, wherein the tacky material is configured to substantially prevent one or more of the packaged goods from sliding off the pallet.

A fourth aspect of the present invention provides a pallet for use in transporting packaged goods, comprising: a front side wall, a right side wall, a rear side wall and a left side wall, the pallet having a central longitudinal axis running from the left side wall to the right side wall; a base configured to support the packaged goods, the base being joined to each of the front side wall, right side wall, rear side wall, and left side wall such that each side wall is orthogonal to the base; a plurality of pairs of stacking feet configured to support the base of the pallet, wherein each stacking foot in each pair of stacking feet is substantially equidistant from the central longitudinal axis of the pallet, and further wherein, the base including an upper surface and a lower surface, the upper surface being substantially planar, and the lower surface including a first set of ribs substantially perpendicular and adjacent to the central longitudinal axis of the pallet, a second set of ribs located within an area defined by an outer perimeter of the plurality of pairs of stacking feet but not where the first set of ribs are located, and a third set of ribs located outside the area of the first and second set of ribs, wherein each of the ribs of the first and second set of ribs are taller than each of the ribs of the third set of ribs.

According to the fourth aspect of the present invention each of the ribs of the first and second set of ribs is configured to support more weight than if each of the ribs of the first and second ribs were about the same lower height as the third set of ribs.

The fourth aspect of the present invention further comprising: a plurality of handles configured to enable a user to grasp the pallet, wherein each of the handles is positioned on the base, and wherein the plurality of handles comprises: a left side wall handle located adjacent to the left side wall and wherein the left side wall handle is substantially symmetrically placed about the central longitudinal axis; a right side wall handle located adjacent to the right side wall and wherein the right side wall handle is substantially symmetrically placed about the central longitudinal axis; a pair of front side wall handles located adjacent to the front side wall; and a pair of rear side wall handles located adjacent to the rear side wall, wherein, each handle in each of the pair of front side wall handles and rear side wall handles are located substantially equidistant from an orthogonal longitudinal axis, wherein, the orthogonal longitudinal axis is substantially perpendicular to the central longitudinal axis, and is substantially equidistant from the left side wall and the right side wall.

According to the fourth aspect of the present invention each of the left side wall handles and the right side wall handles comprises: a plurality of handle strengthening ribs configured to strengthen the left side wall and right side wall respectively, and wherein each of the left side wall handle and right side wall handle further comprises: a plurality of finger recesses located on the left side wall and right side wall, respectively.

The fourth aspect of the present invention further comprising: a left ledge located on the upper surface of the base over the left side wall; and a right ledge located on the upper surface of the base over the right side wall, wherein, the right ledge and the left ledge are configured to substantially prevent one or more of the packaged goods from sliding off the pallet.

According to the fourth aspect of the present invention each of the left ledge and the right ledge comprises: a raised portion of the upper surface of the base in a semi-circular shape with a radius between about 0.120 and about 0.6 inches, and wherein each of the left ledge and the right ledge comprises: a raised portion of the upper surface of the base in a semi-circular shape with a radius of about 0.5 inches.

According to the fourth aspect of the present invention the packaged goods comprise a plurality of beverage trays, and each of the plurality of beverage trays is filled with one or more beverage bottles.

A fifth aspect of the present invention provides a method for transporting packaged goods on a pallet from a first location to a second location, the pallet comprising a base, the base including an upper surface and a lower surface, the pallet further comprising a front side wall, a right side wall, a rear side wall, and a left side wall, the pallet further comprising a plurality of handles and a plurality of stacking feet, the pallet having a central longitudinal axis running between the left side wall and the right side wall, and wherein each of the plurality of stacking feet is substantially equidistant from the central longitudinal axis, and wherein the plurality of stacking feet includes a first pair of stacking feet located adjacent to the left side wall of the pallet, and a second pair of stacking feet located adjacent the right side wall, and wherein, each stacking foot of the first and second pair of stacking feet includes an angled portion, and the method comprising: loading the packaged goods onto the pallet; positioning a first tine of a lifting mechanism adjacent to the left side wall and substantially parallel to the central longitudinal axis and positioning a second tine of a lifting mechanism adjacent to the right side wall and substantially parallel to the central longitudinal axis; lifting the loaded pallet using the lifting mechanism; and transporting the lifted loaded pallet from a first area to a second area by traversing an inclined ramp between the first and second areas, wherein the angled portions of the respective stacking feet enable the pallet to traverse the ramp in a substantially unimpeded manner.

According to the fifth aspect of the present invention the first area comprises a parking lot and the second area comprises one of a sidewalk and an interior floor of a retail store. According to the fifth aspect of the present invention the step of positioning further comprises: positioning the first tine of the lifting mechanism adjacent to an outer wall of each of the plurality of stacking feet located adjacent to the left side wall; and positioning the second tine of the lifting mechanism adjacent to an outer wall of each of the plurality of stacking feet located adjacent to the right side wall.

According to the fifth aspect of the present invention the step of loading further comprises: wrapping a material around the loaded pallet such that the pallet and the packed goods are held substantially together by the wrapped material, and the wrapping material is a plastic material that shrinks when exposed to elevated temperatures.

The fifth aspect of the present invention further comprising; strapping the packaged goods loaded onto the pallet with a strap that is attached to the pallet jack, and wherein the strap is a retractable strap.

A sixth aspect of the present invention is provided for a pallet that has packaged goods placed thereupon, Accordingly, the sixth aspect of the present invention provides a pallet for use in transporting packaged goods, comprising: a front side wall, a right side wall, a rear side wall and a left side wall, the pallet having a central longitudinal axis running from the left side wall to the right side wall; a base and the packaged goods, the base being joined to each of the front side wall, right side wall, rear side wall, and left side wall such that each side wall is orthogonal to the base, the base including an upper surface and a lower surface, the upper surface being substantially planar, and the lower surface including a first set of ribs substantially perpendicular and adjacent to the central longitudinal axis of the pallet; and a plurality of pairs of stacking feet configured to support the base of the pallet, wherein each stacking foot in each pair of stacking feet is substantially equidistant from the central longitudinal axis of the pallet, and further wherein, each rib in the first set of ribs is configured to join a respective pair of stacking feet together to substantially inhibit the respective pair of stacking feet from spreading when the pallet rests upon the stacking feet.

According to the sixth aspect of the present invention, the pallet and packaged goods are configured to be placed in a retail environment, and in a manufacturing environment.

BRIEF DESCRIPTION OF THE DRAWINGS

The novel features and advantages of the present invention will best be understood by reference to the detailed description of the preferred embodiments which follows, when read in conjunction with the accompanying drawings, in which.

DETAILED DESCRIPTION OF THE PREFERRED EMBODIMENTS

Figure 1:
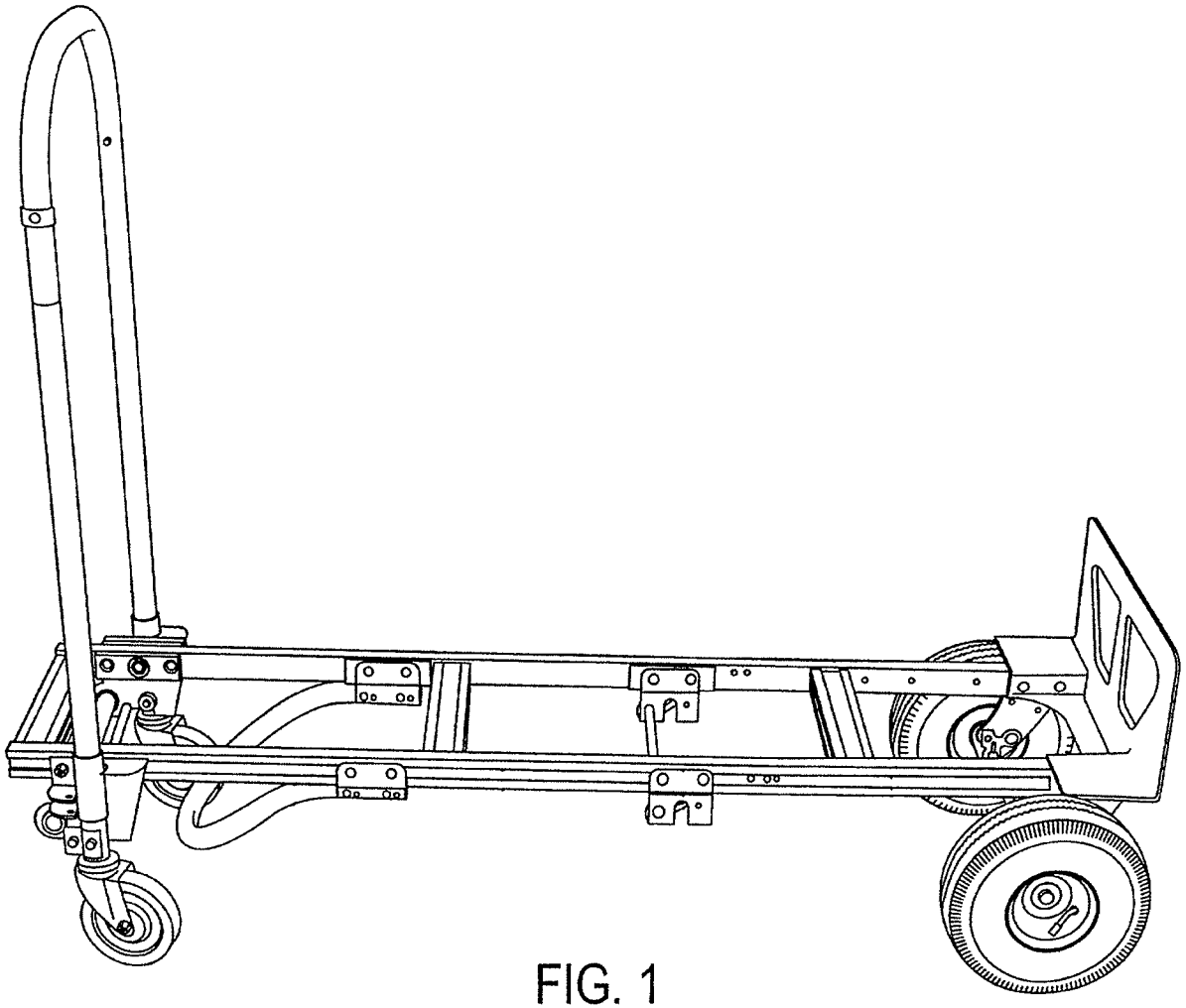
FIG. 1 PRIOR ART
FIG. 1 illustrates a prior art dolly.

The various features of the preferred embodiments will now be described with reference to the drawing figures, in which like parts are identified with the same reference characters. The following description of the presently contemplated best mode of practicing the invention is not to be taken in a limiting sense, but is provided merely for the purpose of describing the general principles of the invention.

I. Summary of Features of Package Goods Pallet 100

Figure 2:
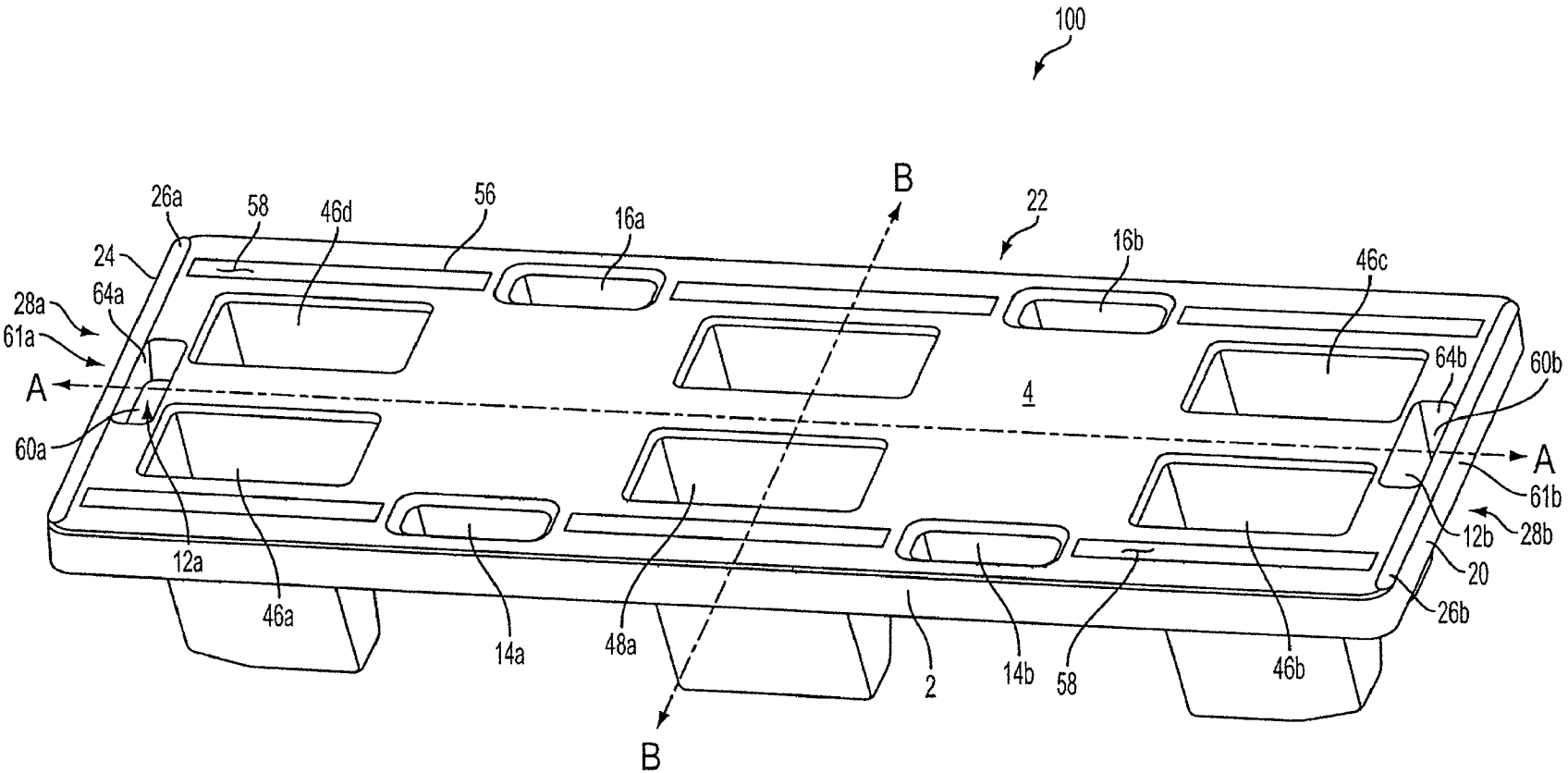
FIG. 2 illustrates a top isometric view of a pallet according to an embodiment of the present invention.

According to a first aspect of the present invention with respect to FIG. 2, a pallet 100 is provided comprising stacking, strengthening, transportation and carrying features according to different embodiments of the present invention.

Figure 16:
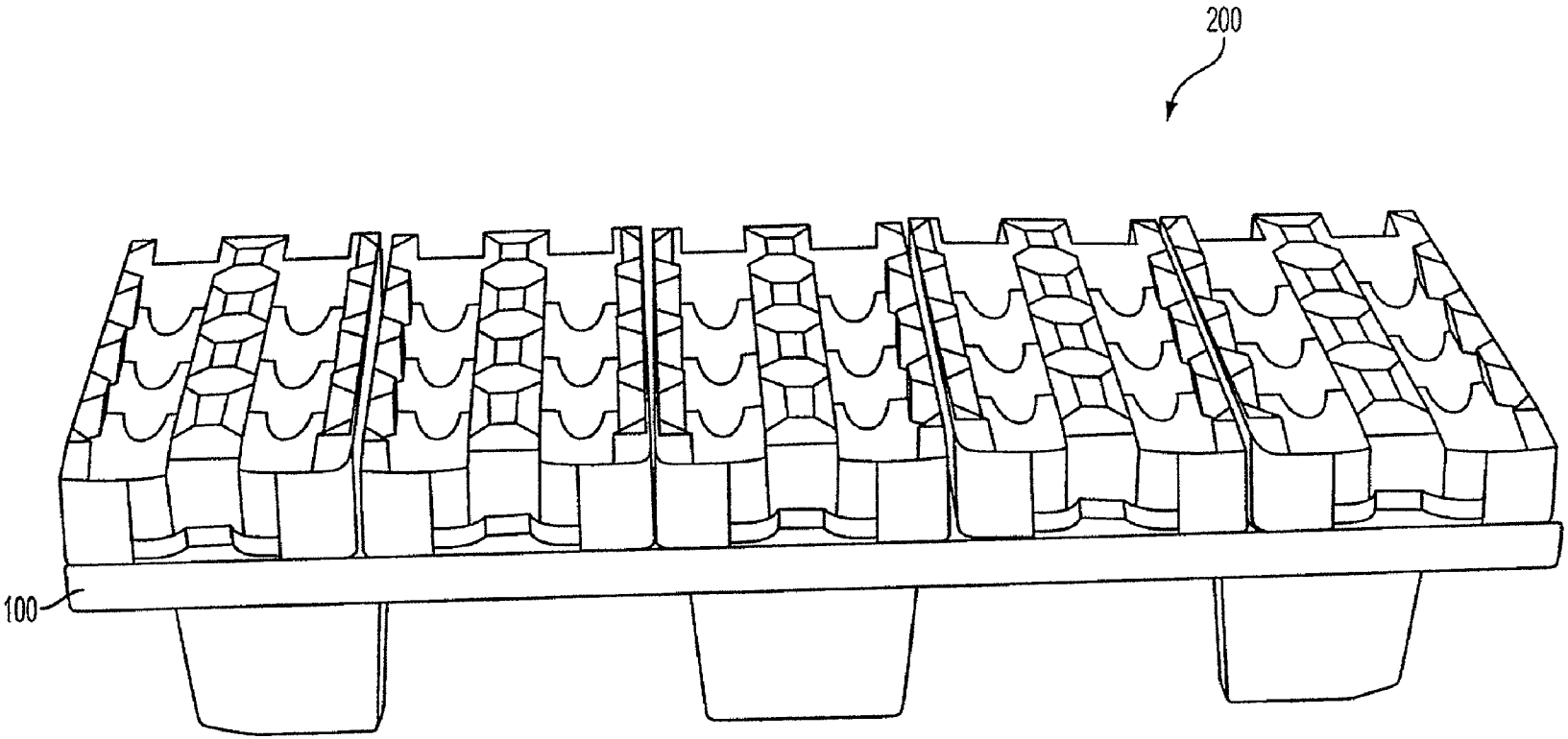
FIG. 16 illustrates the pallet shown in FIG. 2 loaded with empty trays.
Figure 17:
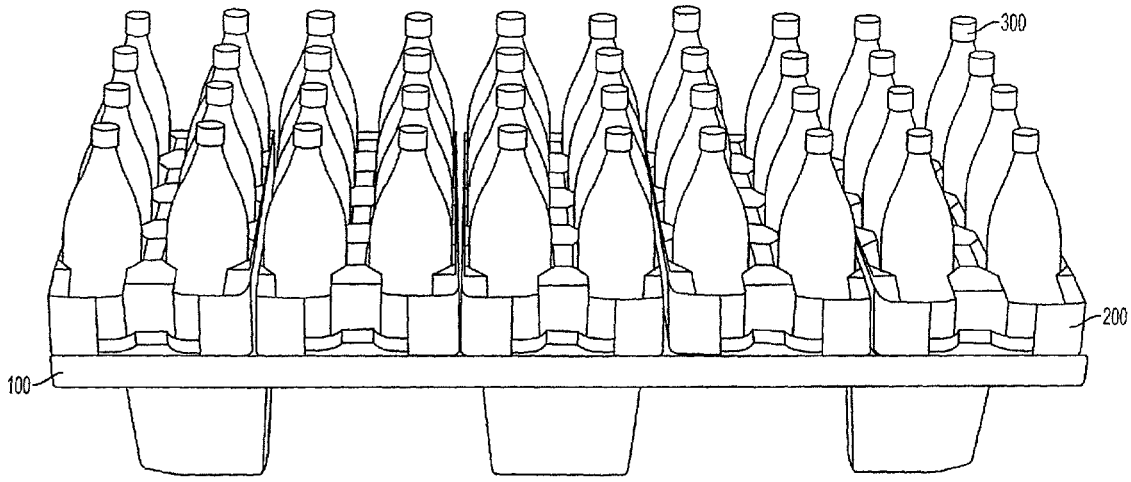
FIG. 17 illustrates the pallet shown in FIG. 2 loaded with beverage trays that are filled with beverage bottles.

Pallet 100 is provided for shipping and displaying of packaged goods. Packaged goods can include virtually any type of retail, wholesale or raw material goods/products that can be packaged for use or sale. Packaged goods for use or sale are loaded onto pallet 100 that can be placed in retail locations, i.e., stores, of any type or size, or manufacturing facilities if the prepackaged goods comprise packaged raw materials. The term "packaged" includes all different types of packages, including, for example, cardboard boxes, wooden crates, plastic or paper wrapping, any other types of enclosures, burlap, string/rope and generally anything that can be used to contain goods. "Packaged goods", therefore, according to exemplary embodiments of the present invention, includes nearly any type of manufactured good or raw material, that can be placed on pallet 100 regardless of whether it is wrapped, packaged, or restrained by any type of material. Pallet 100 with empty trays is shown in FIG. 16, and FIG. 17 illustrates pallet 100 with several beverage trays 200 filled with beverage bottles 300, according to exemplary embodiments of the present invention.

Pallet 100 is described herein for use in shipping and displaying beverage trays according to a preferred embodiment of the present invention. As those of ordinary skill in the art of the present invention can appreciate, and as described above, pallet 100 can be used to ship and display virtually any type of good and/or raw material. Therefore, the ensuing discussion is one merely for illustrative purposes and should not be construed to be limiting the exemplary embodiments of the present invention in any manner whatsoever.

Pallet 100 is provided for shipping and displaying of beverage trays 200, among other items, wherein pallet 100 comprises a plurality of stacking feet 8, 10 joined together by a plurality of angled ribs 40 to substantially prevent or inhibit spreading of stacking feet 8, 10 due to high weight loads. Pallet 100 further comprises a plurality of handles 12*a, b* that include handle-strengthening areas 44 and finger recesses 42 to increase the strength and lifting ergonomics of pallet 100, and an angled surface 30 on the bottom of stacking feet 8*a-d* to facilitate transporting of a loaded pallet 100 from a delivery vehicle to a retail center over certain obstacles.

II. Pallet 100—General Description

Referring now to the drawings, a pallet 100 with a plurality of stacking feet 8, 10 is shown in FIG. 2. Pallet 100 comprises a base 2, and a plurality of stacking feet 8, 10. Base 2 comprises front side wall 18, a right side wall 20, a rear side wall 22, and a left side wall 24. Preferably, the right side wall 20 and left side wall 24 are substantially mirror images of one another, and front side wall 18 and rear side wall 22 are also substantially mirror images of each other. Pallet 100 further comprises left and right handles 12*a, b*, and front and rear handles 14*a, b*, and 16*a, b*. Base 2 of pallet 100 further includes a substantially smooth upper surface 4 and lower surface 6. Base upper surface 4 of base 2 further includes a plurality of base surface recesses 56 for locating rubber or other tacky or sticky material 58. Tacky material 58 substantial prevents or inhibits beverage trays 200 from sliding off base upper surface 4. Base lower surface 6 comprises a plurality of perimeter ribs 36, a plurality of central ribs 38, as well as a plurality of angled V-shaped ribs (V-ribs) 40. V-ribs 40, according to a preferred embodiment of the present invention, keep stacking feet 8*a-d* and 10*a, b* from spreading when pallet 100 is loaded with a plurality of beverage trays 200 partially or fully filled with beverage bottles 300.

Figure 5:
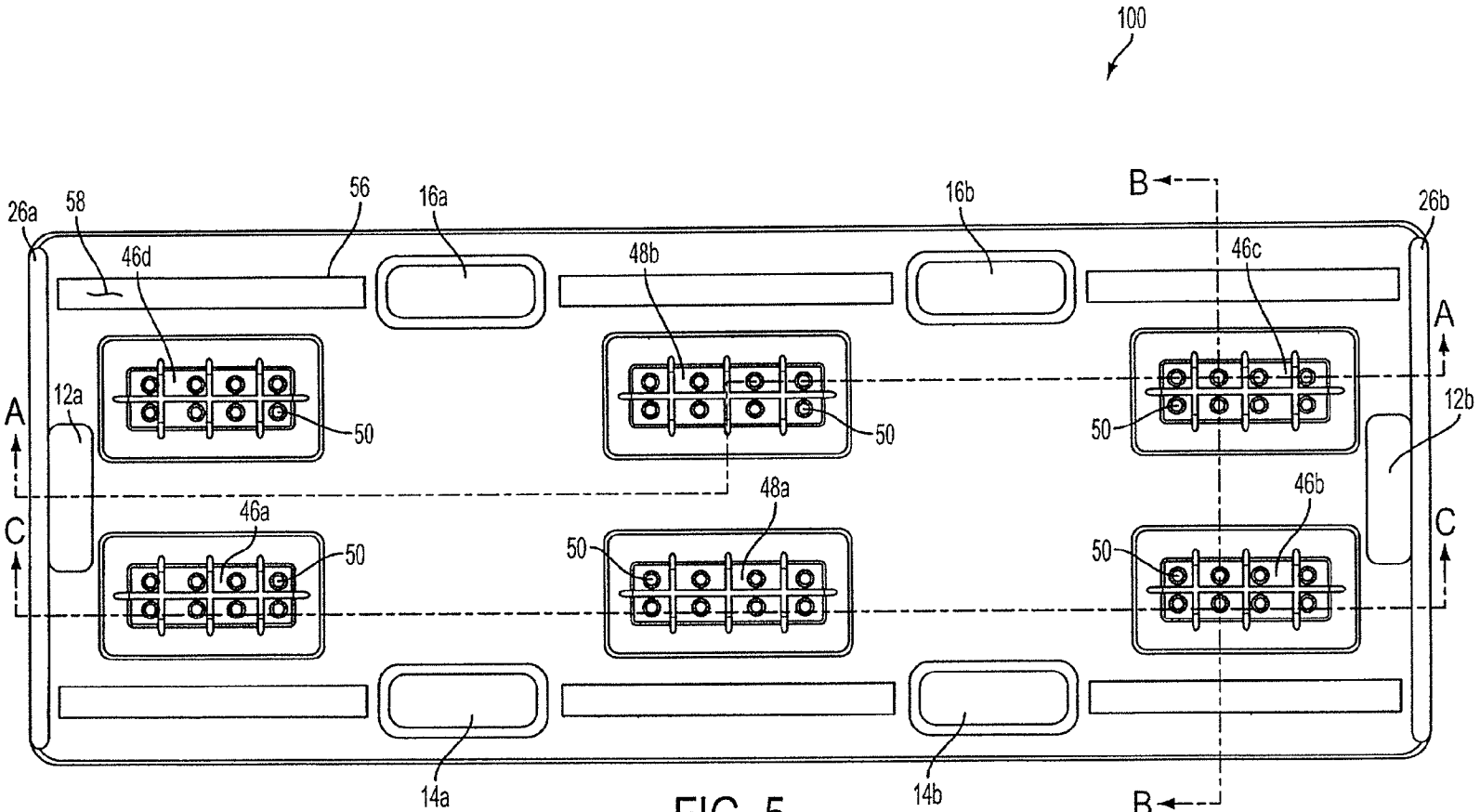
FIG. 5 illustrates a top view of the pallet shown in FIG. 2.

Stacking feet 8*a-d* comprise a plurality of stacking feet walls 32, stacking feet floor 34 and a stacking foot angled surface 30. Stacking feet 10*a, b* comprise a plurality of stacking feet walls 32, and stacking feet floor 34. As best seen in FIGS. 2 and 5, and which shall be described in greater detail below, stacking feet 8*a-d* comprise outer stacking feet recess area 46*a-d*, and stacking feet 10*a, b* comprise inner stacking feet recess areas 48*a, b*. Both inner and outer stacking feet recess areas 48, 46 comprise a plurality of stacking feet inner ribs 54 according to a preferred embodiment of the present invention. Pallet 100 can be stacked upon another like, substantially similar pallet 100. When so stacked, because of pallet's 100 symmetry, there is substantially no difference between an upper pallet 100' stacked upon a lower pallet 100 when front side wall 18' of upper pallet 100' is facing the same direction as front side wall 18 of lower pallet 100, or when it is facing rear side wall 22 of lower pallet 100. The former configuration is referred to as a "0°" stacking orientation, and the latter configuration is referred to as the "180°" stacking orientation. Pallet 100 hereof can advantageously be constructed by injection molding whereby the entire pallet 100 may be formed as a unitary article from a synthetic resin such as polyethylene or high density polyethylene (HDPE). Other materials that can be used to manufacture pallet 100 comprise polypropylene. According to an exemplary embodiment of the present invention, pallet 100 is between about 15" to about 21" in width, between about 45" and 50" in length, and between about 7" and 10" in height. According to a preferred embodiment of the present invention, pallet 100 is about 18" in width, 47.5" in length, and about 8.5" in height. Pallet 100 shall now be described in greater detail according to the different embodiments of the present invention.

A. Base 2.

1. General Description.

Referring now to FIGS. 2-7, base 2 is shown, comprising front wall 18, right side wall 20, rear side wall 22, left side wall 24, base upper surface 4, base lower surface 6. Front wall 18 is substantially parallel to rear side wall 22, and right side wall 20 is substantially parallel to left side wall 24. Base 2 is preferably substantially planar and smooth, aside from those areas noted below, and base upper surface 4 and base lower surface 6 are substantially parallel to each other, and substantially orthogonal to front wall 18, right side wall 20, rear side wall 22, left side wall 24, which are also substantially orthogonal to each other.

Front side wall 18 and rear side wall 20 are substantially similar in terms of height and length, and comprise certain similar features. Right side wall 20 and rear side wall 24 are substantially similar in terms of height and length, and comprise certain similar features. Pallet 100 is preferably substantially symmetrical about a central longitudinal axis A-A as shown in FIG. 2, and is also preferably substantially symmetrical about a central orthogonal axis B-B also as shown in FIG. 2.

2. Base Surface Recess 56 and Ledge 26.

Upper surface 4 of base 2 is substantially planar and smooth, aside from base surface recesses 56, and left, right handles 12*a, b*, front handles 14*a, b*, and rear handles 16*a, b*. Base surface recesses 56 are formed to hold within them a tacky or sticky material (tacky material) 58, preferably rubber. Tacky material 58 substantially prevents or inhibits empty or loaded beverage containers 200 from sliding off base upper surface 4 when placed thereupon. Although shown as rectangular in shape, and substantially uniform in size and alignment, those of ordinary skill in the art of the present invention can appreciate that base surface recesses 56 can be formed in a variety of different shapes (circular, oval, square, triangular, among others) and locations on base upper surface 4. Further assisting in preventing or inhibiting empty or loaded beverage container 200 from sliding off base upper surface 4 are ledges 26*a*, b, which can be more readily seen in FIGS. 3 and 5. Ledges 26*a*, b rise above upper surface 4 over left and right side walls 24, 22, respectively, and are semi-circular in shape with a radius in the range of about 0.120" to about 0.6", according to an exemplary embodiment of the present invention. According to a more preferred embodiment of the present invention, ledges 26*a, b* are semi-circular in shape with a radius of about 0.5". Of course, as those of ordinary skill in the art of the present invention can appreciate, ledges 26*a, b* can be of many different shapes, and still function to assist in retaining beverage trays 200 from slipping off of upper surface 4 of base 2 of pallet 100. For example, ledges 26*a, b* can be elliptical, triangular, square or rectangular, among other shapes.

3. Handles 12, 14 and 16.

Figure 3:
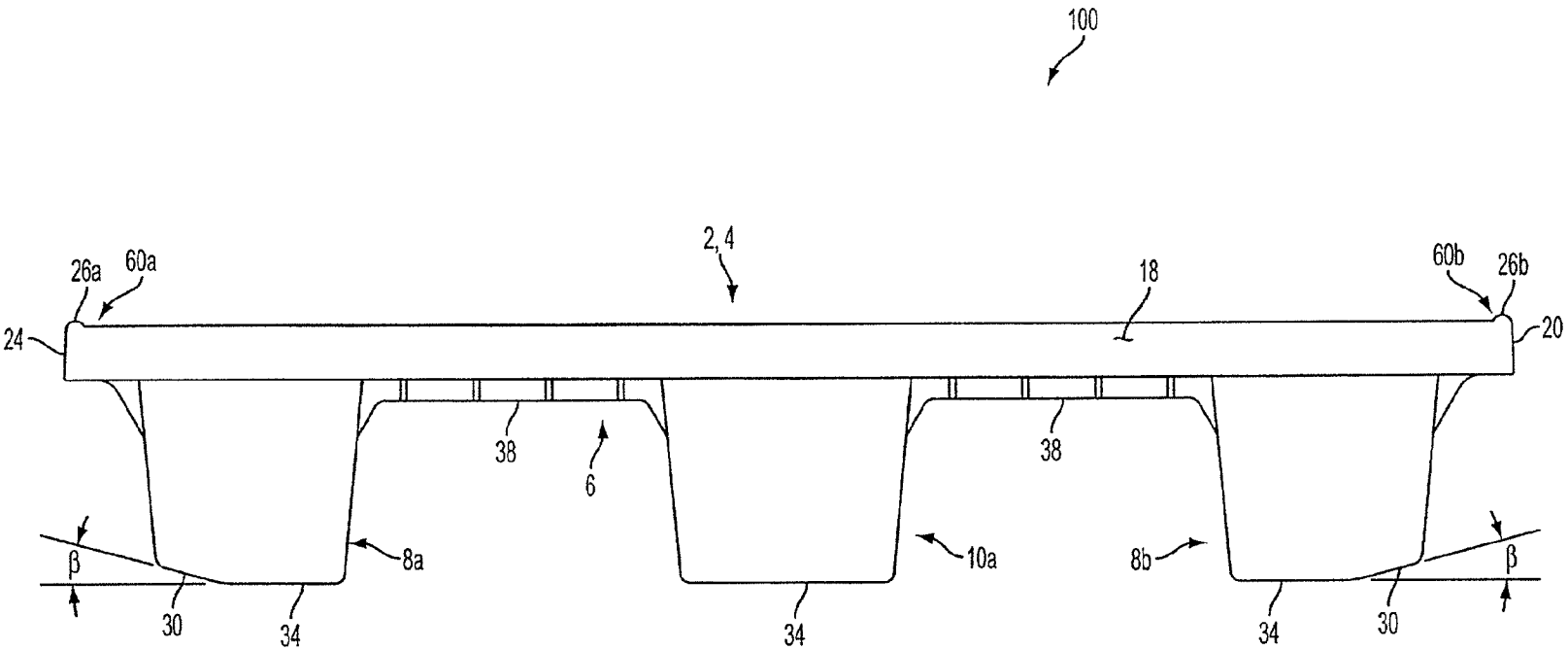
FIG. 3 illustrates a front view of the pallet shown in FIG. 2.
Figure 4:
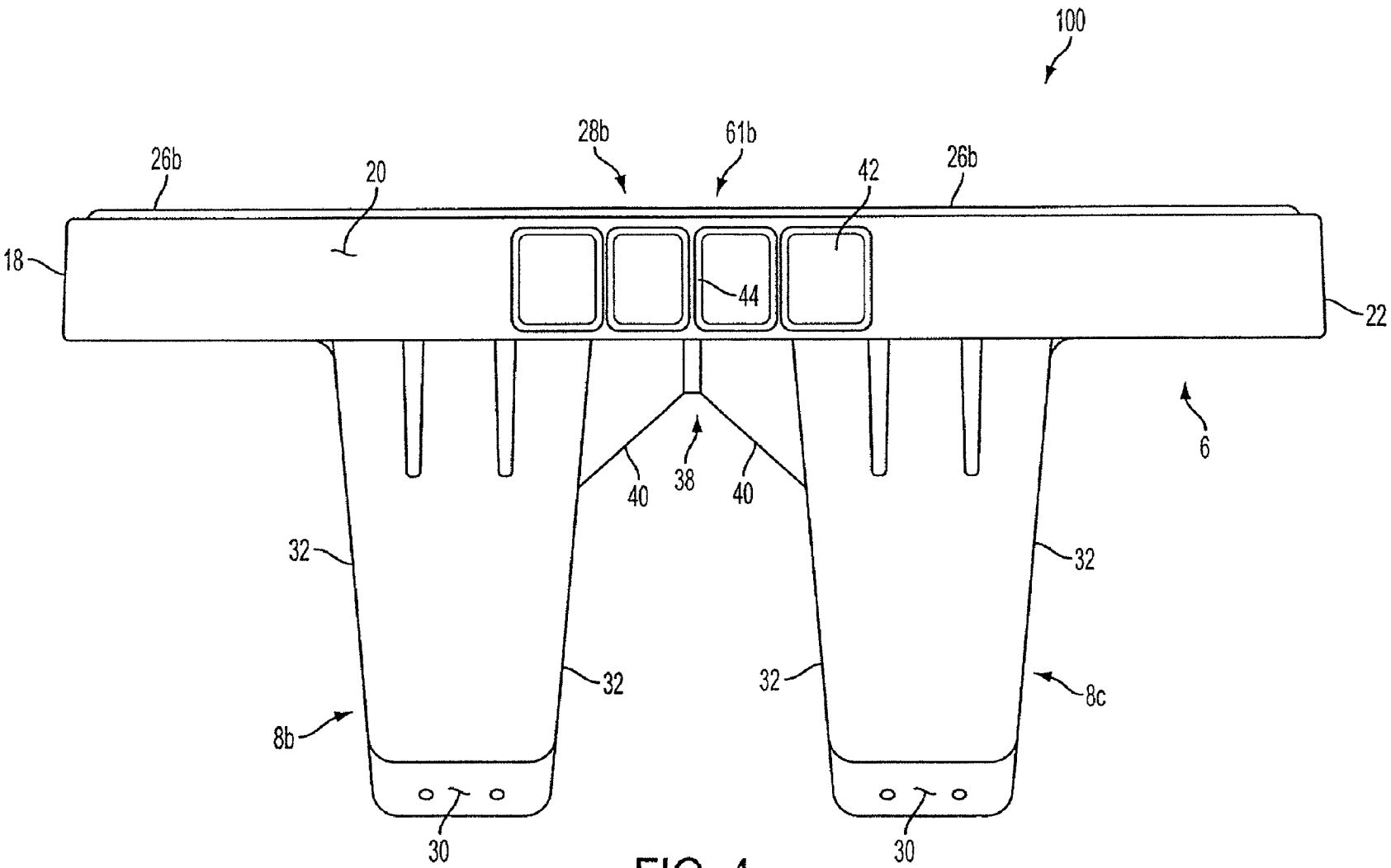
FIG. 4 illustrates a right side view of the pallet shown in FIG. 2.

As shown in FIGS. 2-7, pallet 100 comprises a plurality of handles that provide an ergonomic means for retrieving pallet 100. Referring especially to FIGS. 2-4, handle grip areas 28*a, b* include handles 12*a, b* that are located along the central longitudinal axis A-A. Handles 12*a, b* include inner finger recess areas 60*a, b*, and outer finger recess area 61*a, b*. Inner finger recess area 60*a, b*, is substantially similar to outer finger recess area 60*a, b*, which is discussed in detail below, and therefore will not be discussed in detail nor is it displayed in the accompanying drawings. As shown in FIGS. 2 and 3, inner finger recess areas 60*a, b* are located at inner walls 64*a, b* that are parallel to left side wall 24 and right side wall 22 respectively. Finger recess areas 60*a, b* comprise a plurality of inner finger recesses 62 that are slight indentations in the inner wall 64*a, b* within which a user's fingers would comfortably fit. Finger recess 62 provide an ergonomic means for a user to grab and lift pallet 100, especially if it is loaded.

Outer finger recess areas 61*a, b*, comprise handle finger recesses 42 and handle strengthening ribs 44. Outer finger recess areas 61*a, b* are respectively located on left side wall 24 and right side wall 22. Handle finger recesses 42 (see FIG. 4) are designed to allow a user's finger to fit into when lifting pallet 100. This could occur, for example, if a user lifts pallet 100 with their right hand only while alongside right side wall 22. Separating handle finger recesses 42 are a plurality of handle strengthening ribs 44 that provide additional material to handles areas 28*a, b* to strengthen and stiffen base 2 in those particular locations, thereby substantially preventing or reducing the amount of bending that might other wise occur when lifting pallet 100 when loaded with beverage containers 200. According to a preferred embodiment of the present invention, pallet 100 does not include inner finger recess areas 60*a, b*.

Figure 6:
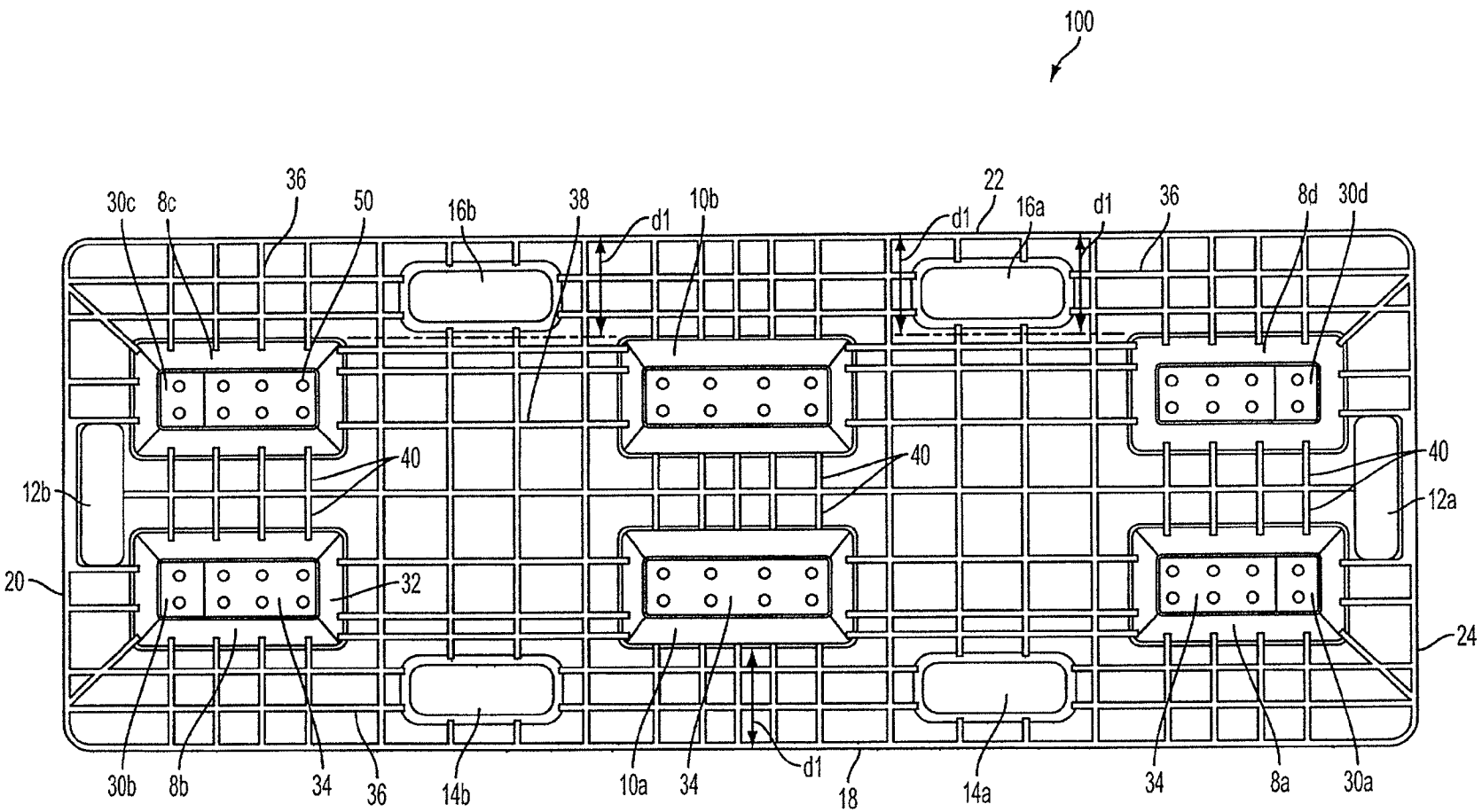
FIG. 6 illustrates a bottom view of the pallet shown in FIG. 2.
Figure 7:
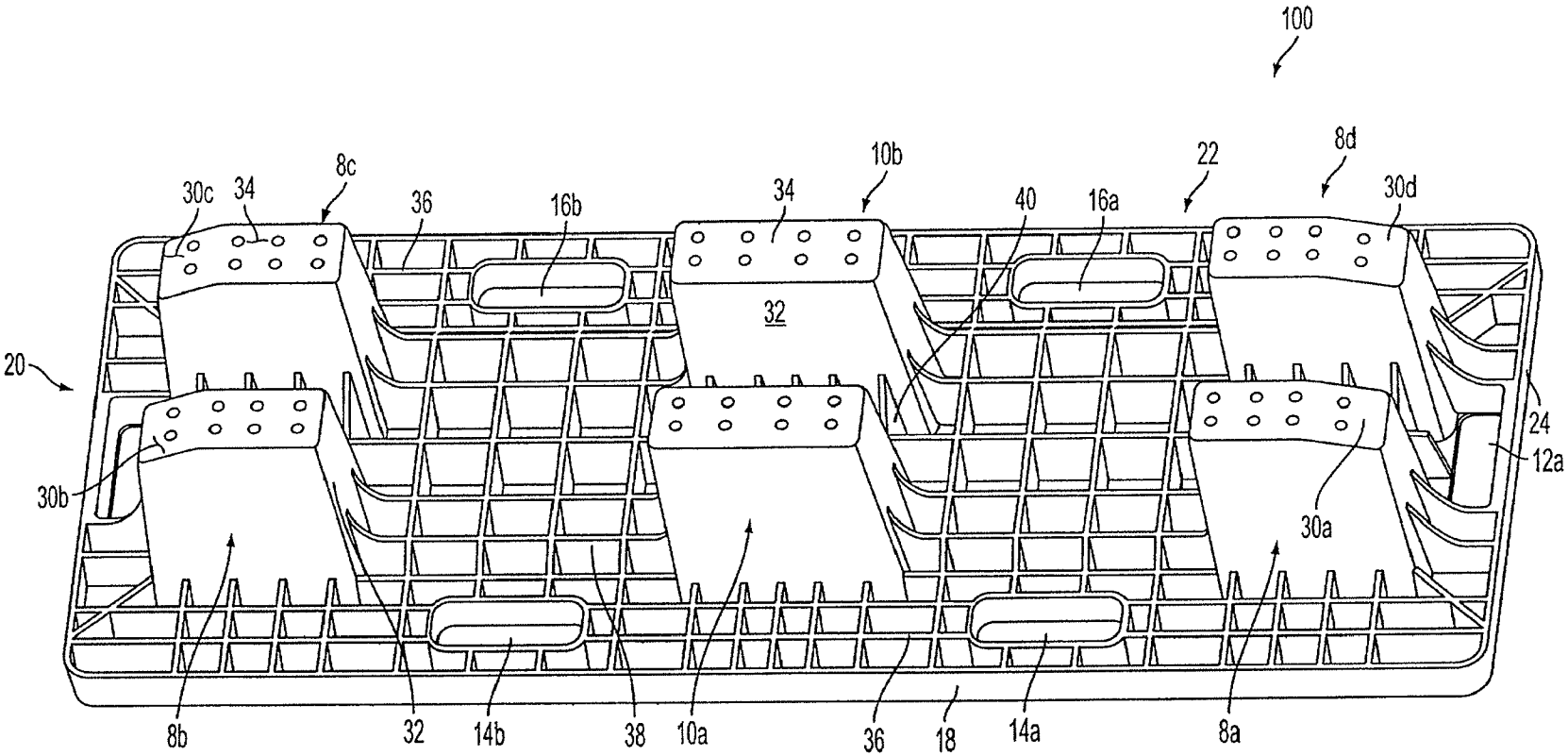
FIG. 7 illustrates a bottom isometric view of the pallet shown in FIG. 2.

Also shown in FIGS. 5-7 are front handles 14*a, b*, and rear handles 16*a, b*. Although not shown in FIGS. 5-7, any one, combination, or all of front handles 14*a, b* and rear handles 16*a, b* can also employ finger recess areas 62 and/or handle strengthening ribs 44 as well as inner finger recess areas 60*a, b*. Front handles 14*a, b* are substantially symmetrically located about orthogonal central axis B-B (as shown in FIG. 2), as are rear handles 16*a, b*. Front handles 14*a, b* and rear handles 16*a, b* provide additional means for lifting pallet 100.

4. Perimeter Ribs 36 and Central Ribs 38.

Figure 9:
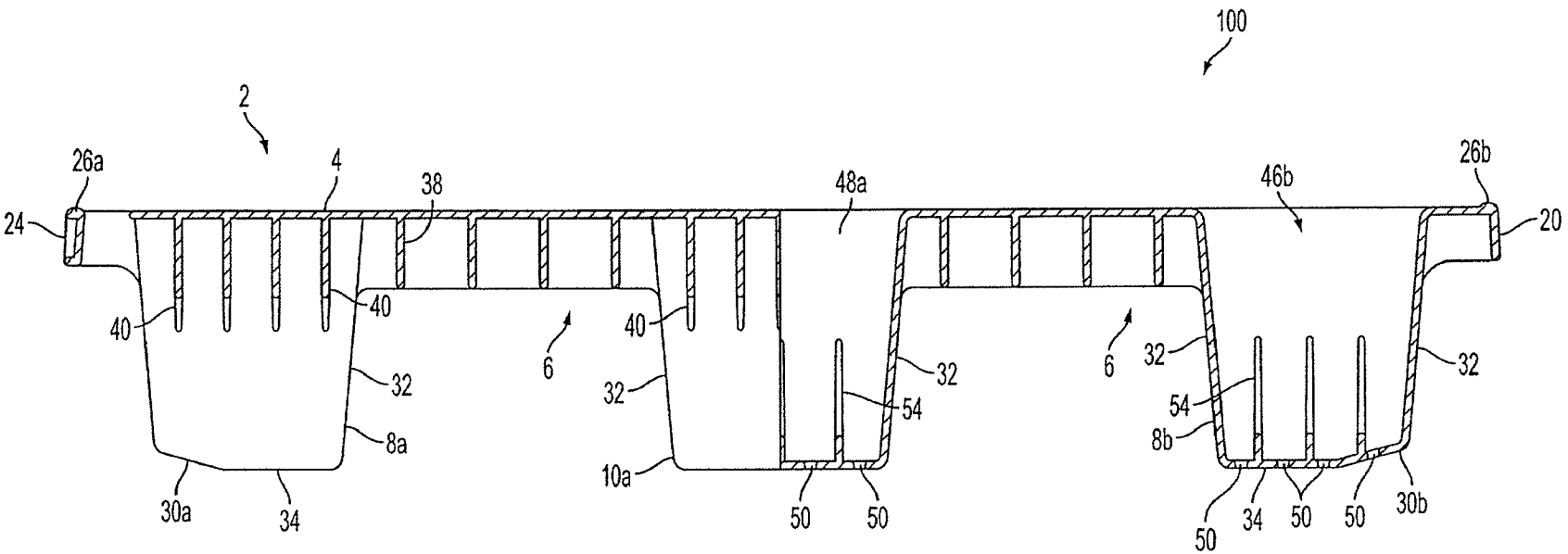
FIG. 9 illustrates a front partial view along line A-A of the pallet shown in FIG. 5.
Figure 10:
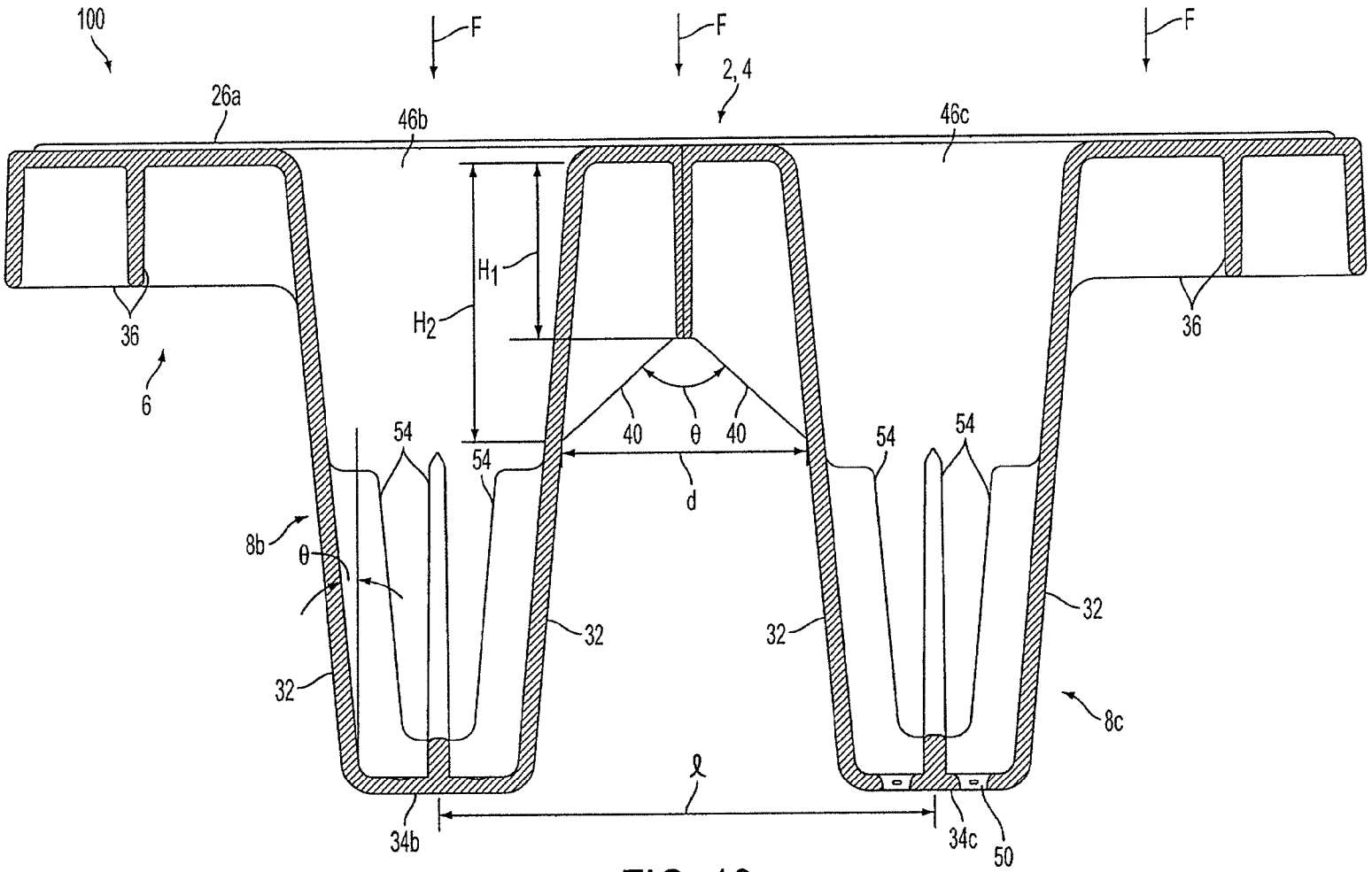
FIG. 10 illustrates a right partial side view along line B-B of the pallet shown in FIG. 5.

In regard to perimeter ribs 36 and central ribs 38, attention is directed to FIGS. 5-7, 9 and 10. FIG. 5 illustrates a top view of the pallet shown in FIG. 2, FIG. 6 illustrates a bottom view of the pallet shown in FIG. 2, FIG. 7 illustrates a bottom isometric view of the pallet shown in FIG. 2, FIG. 9 illustrates a partial front view along line A-A of the pallet shown in FIG. 5, and FIG. 10 illustrates a partial right side view along line B-B of the pallet shown in FIG. 5. Perimeter ribs 36 provide substantial strength and stiffness to pallet 100, without using too much additional plastic material. According to a preferred embodiment of the present invention, as shown in FIGS. 6, 7, 9, and 10, perimeter ribs 36 do not extend downward from base lower surface 6 as much as central ribs 38 or V-ribs 40 (i.e., perimeter ribs 38 are not as "tall" or "deep" as central ribs 38 and V-ribs 40). Perimeter ribs are about 50% to 75% of the height of central ribs 38 and V-ribs 40. According to a preferred embodiment of the present invention, perimeter ribs 35 are 67% of the height of central ribs 38 and V-ribs 40. According to a preferred embodiment of the present invention, perimeter ribs 3B are about 2.27" high, and central ribs 38 and V-ribs 40 (at the bottom of the "V" shape) are about 3.02" high.

5. V-Ribs 40.

Referring now to FIGS. 5-7, and 10, V-ribs 40 are shown disposed along the central longitudinal axis A-A and joining together outer and inner stacking feet 8*a-d*, and 10*a, b*. At their center, V-ribs 40 are substantially the same height or depth as central ribs 38. From their center, V-ribs 40 form a "V" shape and rise up and meet stacking feet walls 32 of outer and inner stacking feet 8*a-d*, and 10*a, b*. According to an exemplary embodiment of the present invention, angle Φ, formed between the two walls of V-rib 40 that rise up stacking walls 32, is between about 80° and about 100°. According to a preferred embodiment of the present invention, angle Φ bis about 90°.

V-ribs 40 provide additional load bearing strength to pallet 100 by substantially preventing stacking feet 8*a-d* and 10*a, b* from spreading when filled beverage trays 200 are loaded onto pallet 100. According to exemplary embodiments of the present invention, pallets 100 can be loaded with as many as 45 beverage trays 200*a* or 20 beverage trays 200*b*. Beverage trays 200*a* generally contain about twenty-four beverage cans 300*a* each, and beverage trays 200*b* contain about eight 2-liter beverage bottles 300*b* each, as shown in FIG. 17. Beverage cans 300*a* weigh about 12 oz each, while beverage bottles 300*b* weight about 67.6 oz each. When fully loaded, therefore, pallet 100 can support between about 700 and 1,000 lbs. As one of ordinary skill in the art can appreciate, stacking feet 8*a-d* and 10*a, b* therefore must support between about 117 lbs each to about 167 lbs each. Supporting about 167 lbs. each can cause premature failure of pallet 100 by spreading outer and inner stacking feet 8*a-d* and 10*a, b*. Referring to FIG. 10, "spreading" means that if a sufficient force F were applied to upper surface 6 of pallet 100, the force transferred to each stacking foot 8*b, c* (approximately F/6 according to an exemplary embodiment of the present invention, presuming an even distribution of force F along upper surface 6 of base 2 of pallet 100) would cause the distance l between outer stacking feet 8*c, d* to increase. A sufficiently high force F can also cause stacking feet 8*c, d* to twist, or move parallel to the central longitudinal axis A-A. Regardless of the direction of movement, such movement, over repeated cycles of loading and unloading can cause immediate catastrophic failure if the force F is too high, or eventual catastrophic failure over repeated cycles of flexing of the plastic material.

The combined weight of the loaded beverage bottles 300 is transferred to stacking feet 8*a-d*, and 10*a, b*, which can cause them to spread apart from each other. V-ribs 40 substantially prevents stacking feet 8*a* from spreading apart from stacking foot 8*d*, stacking feet 8*b* from spreading apart from stacking foot 8*b*, and stacking feet 10*a* from spreading apart from stacking foot 10*b*, by transferring the weight or force that is imparted upon the stacking foot from a compressive force (the foot upon the ground) into a tensile force borne by the V-rib. The design of V-rib 40 ultimately determines how much tensile force it can withstand. Design parameters of V-rib 40 include the amount of material or volume of material used, (according to a preferred embodiment of the present invention, plastic) first height $H_1$, distance d, angle θ, and second height $H_2$. The design of V-rib 40 according to an exemplary embodiment of the present invention substantially maximizes its tensile strength capacity while minimizing the volume of material used for the expected weight of beverage bottles 300 (or other packaged goods) loaded upon pallet 100.

B. Stacking Feet 8, 10

1. General Description.

As discussed above, outer stacking feet 8*a-d* and inner stacking feet 10*a, b* are subjected to significant loads from beverage bottles 300 when loaded on pallet 100. According to a preferred embodiment of the present invention, there are six stacking feet: four outer stacking feet 8*a-d*, and two inner stacking feet 10*a, d*, though, as one of ordinary skill in the present invention can appreciate, there can be alternative arrangements in the number of stacking feet, as well as their arrangements under base 2 of pallet 100. Stacking feet 8*a-d* and 10*a, b* each comprise at least four stacking feet walls 32, which are formed at an angle of about 5° from the perpendicular, as shown in FIG. 10. Offsetting each stacking feet wall 32 from the perpendicular by about 0° means that each stacking foot 8*a-d*, 10*a, b*, is generally conical in shape, which assists in stacking and de-stacking, as discussed in detail below. Furthermore, each stacking feet 8*a-d* and 10*a, b* comprises stacking feet floor 34, and within stacking feet floors 34 are formed a plurality of drainage holes 50.

2. Inner ribs 54 and stacking of Pallets 100.

Figure 20:
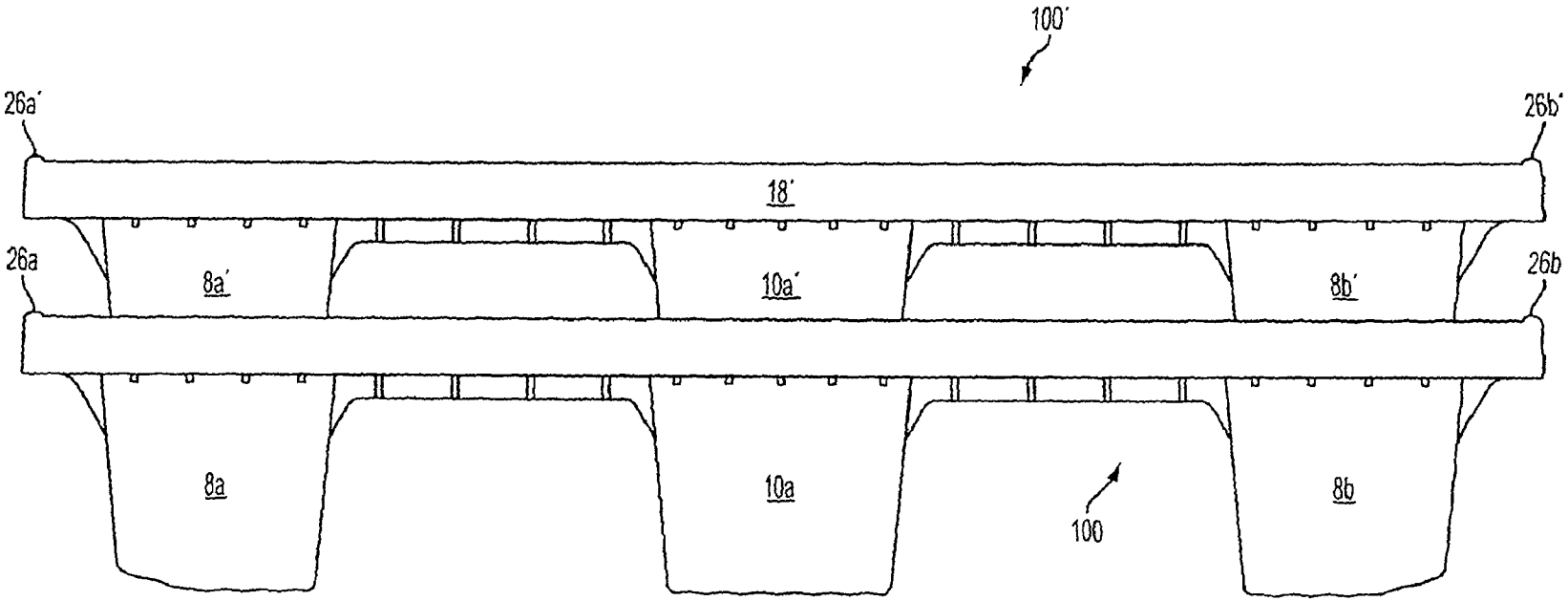
FIG. 20 illustrates a front side view of an upper pallet stacked upon a lower, similar pallet according to an embodiment of the present invention.
Figure 21:
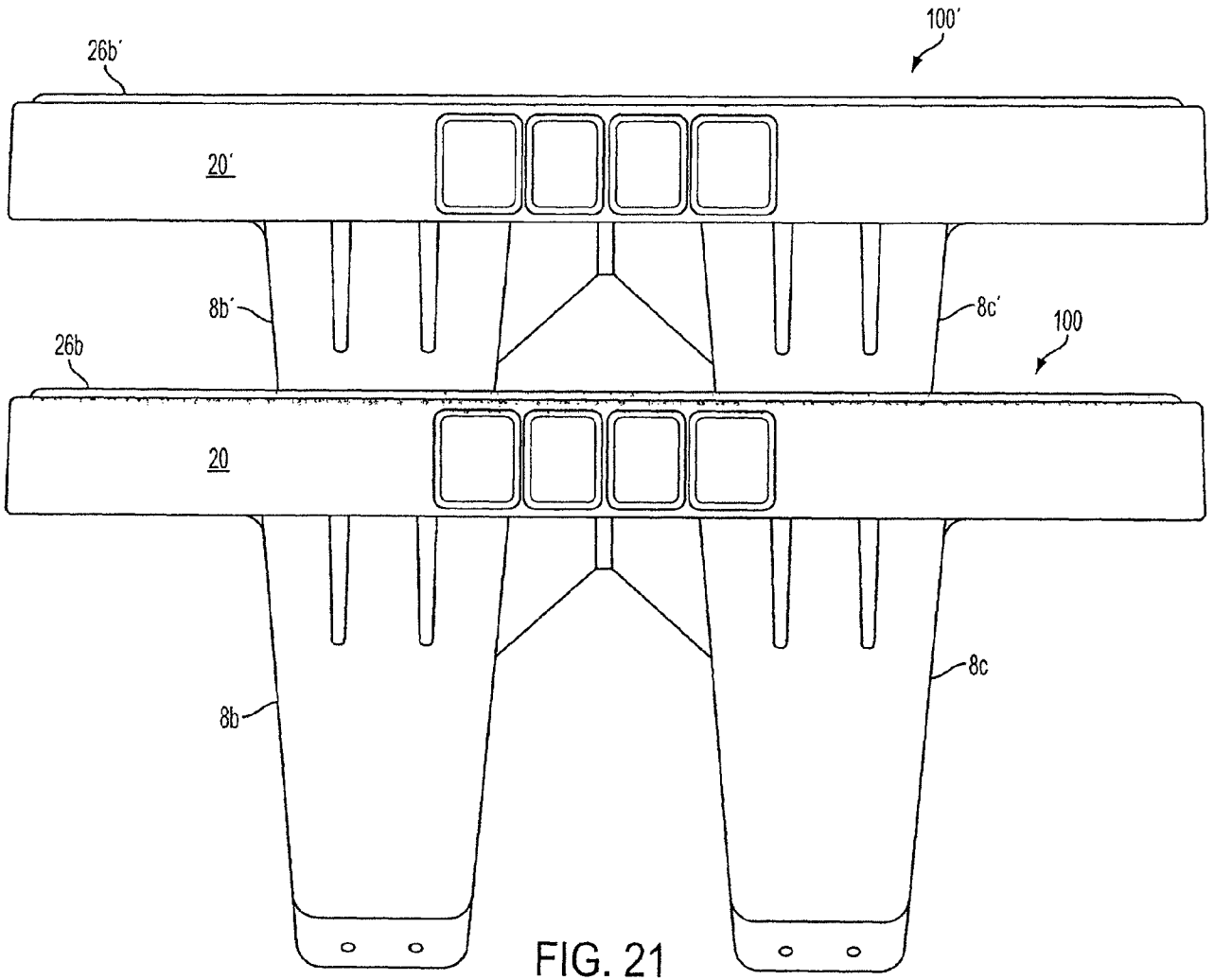
FIG. 21 illustrates a side view of the upper and lower pallets shown in FIG. 20.

According to an exemplary embodiment of the present invention, as briefly described above, pallets 100 can be stacked upon each other. FIG. 20 illustrates a front side view of upper pallet 100' stacked upon lower pallet 100 in a 0° stacking orientation according to an embodiment of the present invention, and FIG. 21 illustrates a right side view of pallets 100', 100 shown in FIG. 20. Because of the substantially symmetry of pallet 100, there is no difference in stacking heights if upper pallet 100' is stacked upon lower pallet 100 faces the same direction (i.e., front side wall 18' of upper pallet 100' faces the same direction as front side wall 18 of lower pallet 100; the "0° stacking orientation") or if upper pallet 100' has been rotated 180° (i.e., rear side wall 22' of upper pallet 100' faces the same direction as front side wall 18 of lower pallet 100; the "180 stacking orientation").

Referring to FIGS. 5, 8, and 9-12, stacking feet inner ribs (inner ribs) 54 of stacking feet 8*a-d*, and 10*a, b* can be seen. Inner ribs 54 prevent an upper pallet 100', when stacked upon lower pallet 100, from being wedged in too tightly. If inner ribs 54 were not used, then when upper pallet 100' was stacked upon lower pallet 100, upper stacking feet 8*a-d'* and 10*a, b'* of upper pallet 100' could become wedged into lower stacking feet 8*a-d* and 10*a, b* of lower pallet 100, thereby preventing easy separation of one pallet 100 from another. The effect of wedging becomes more pronounced when additional upper pallets 100' are stacked upon lower pallets 100, and even more so if the stacked pallets 100', 100 are tossed about.

Figure 8:
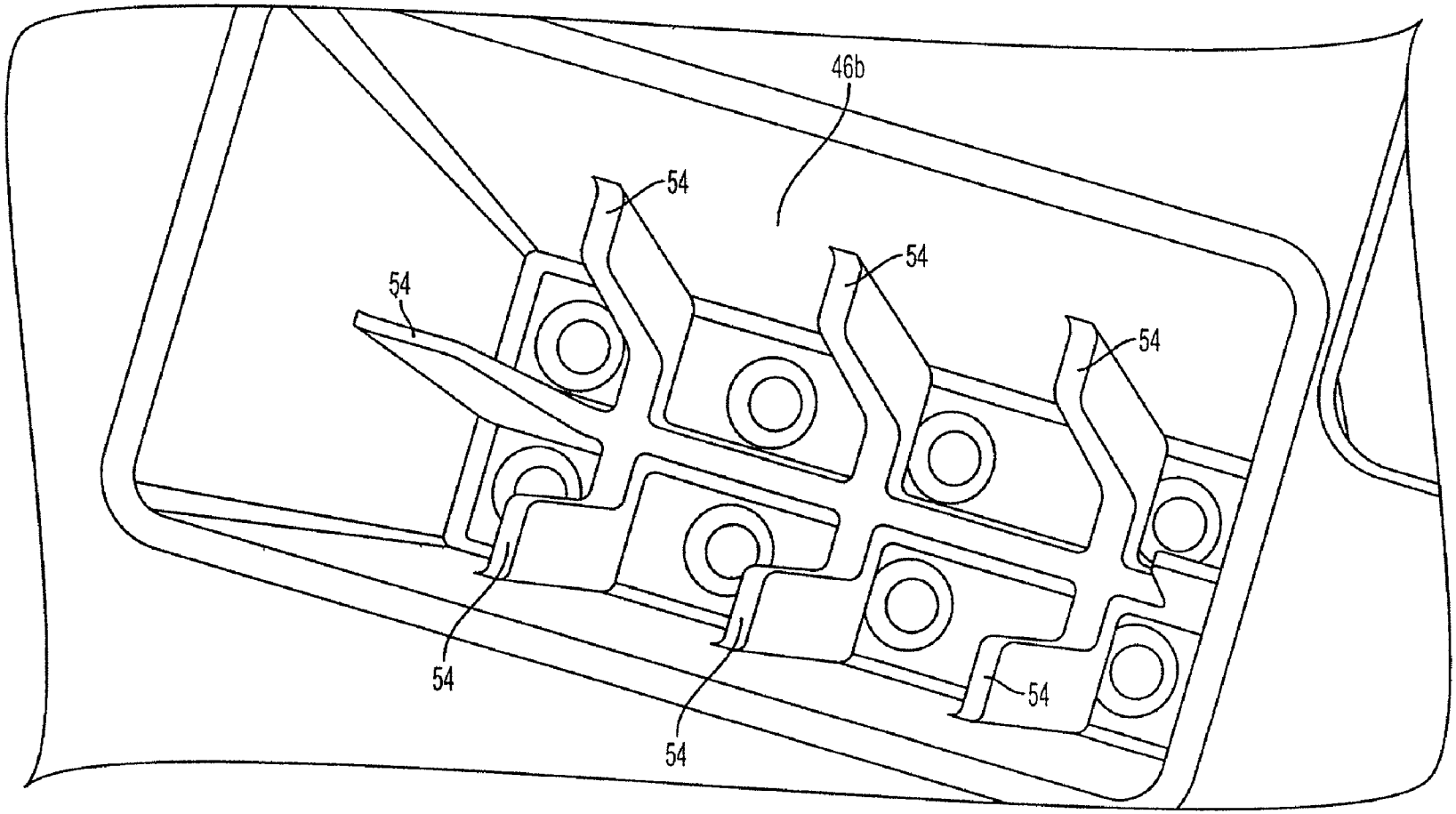
FIG. 8 illustrates a close-up isometric view of an interior portion of a stacking foot of the pallet shown in FIG. 2.
Figure 11:
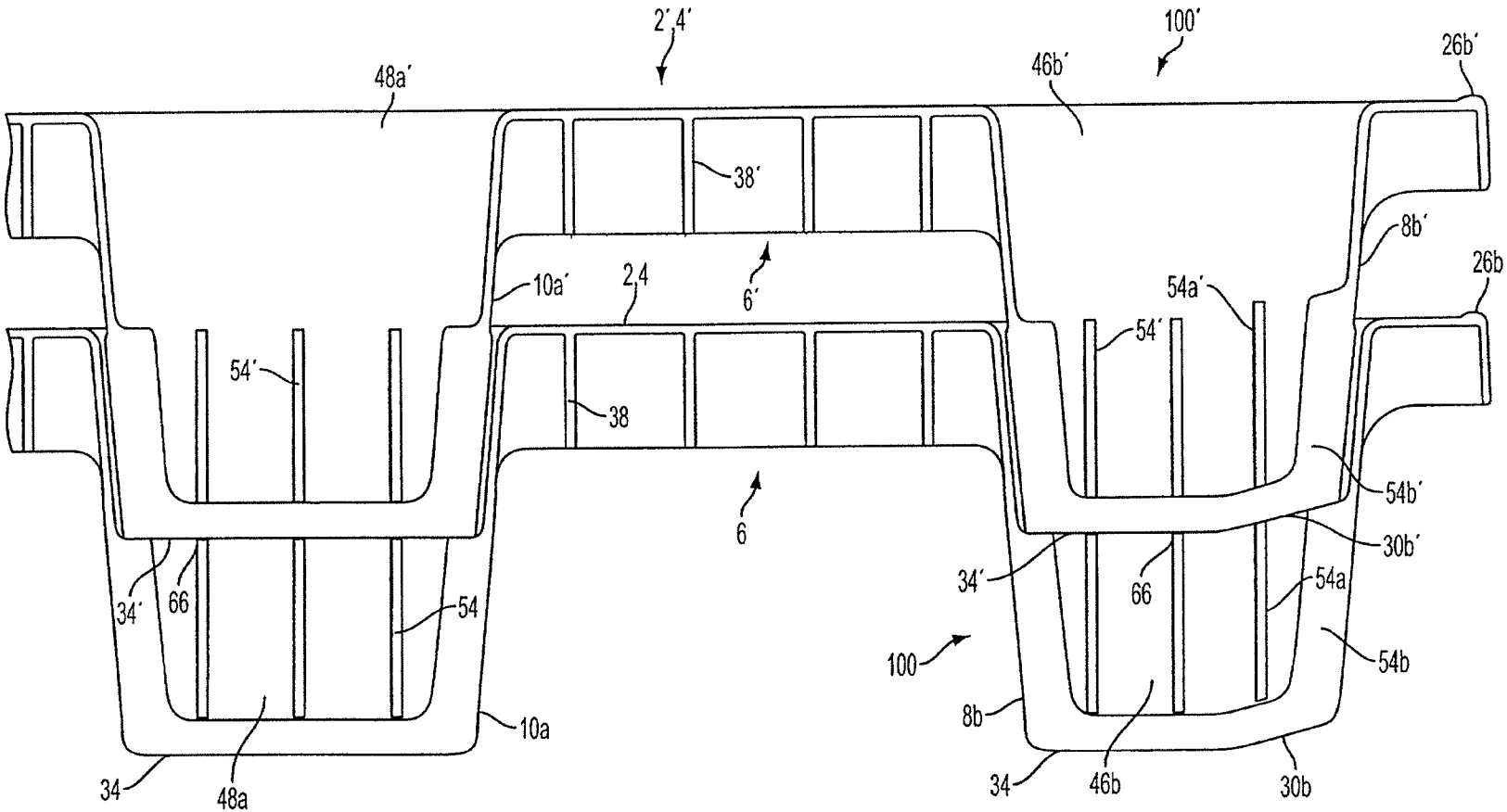
FIG. 11 illustrates a front partial view of an upper pallet nested within a lower similar pallet according to an embodiment of the present invention, wherein the partial view of the upper and lower pallets is taken along line C-C of the pallet shown in FIG. 5.
Figure 12:
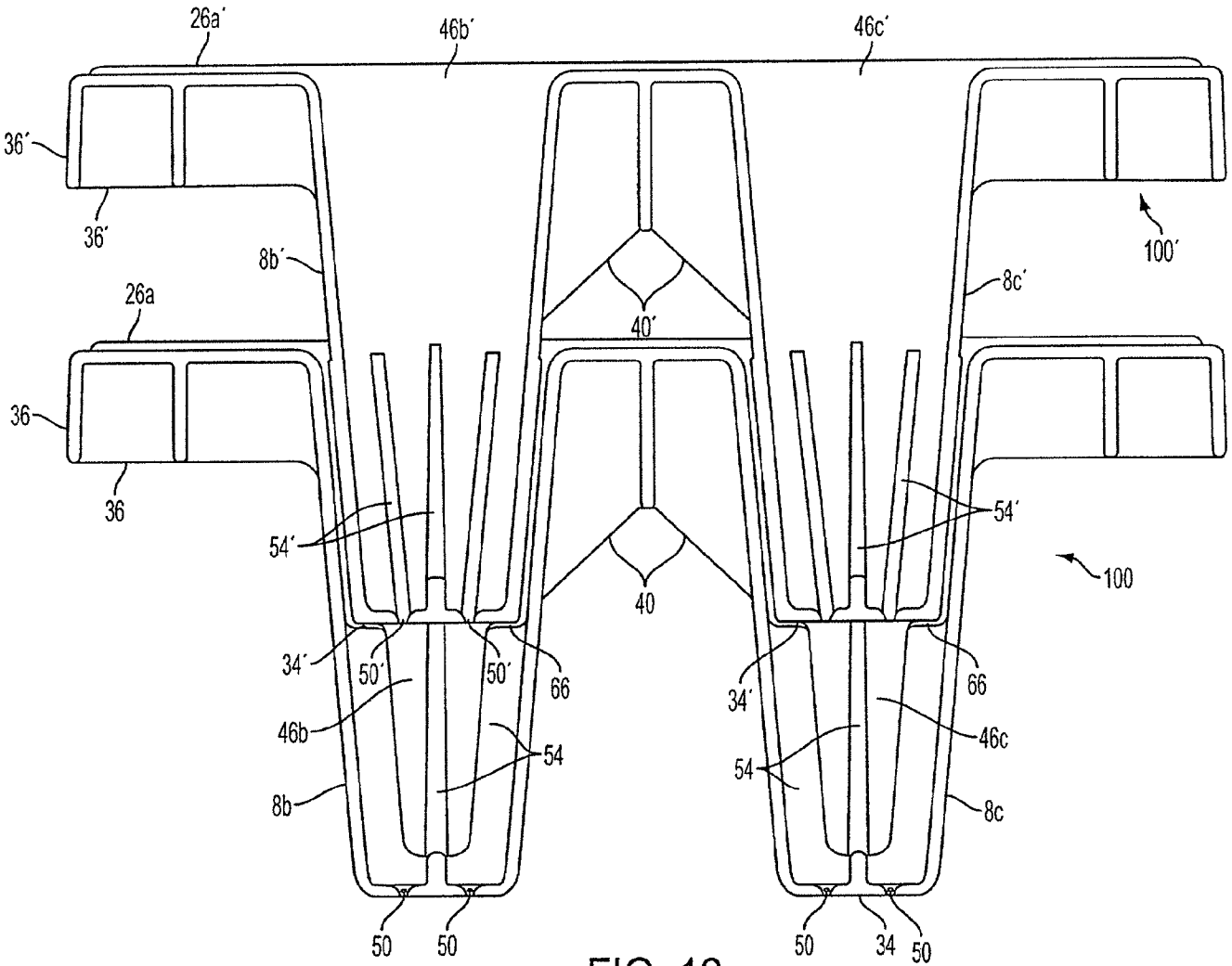
FIG. 12 illustrates a side partial view of an upper pallet nested within a lower similar pallet according to an embodiment of the present invention, wherein the partial view of the upper and lower pallets is taken along line B-B of the pallet shown in FIG. 5.

Inner ribs 54 extend between about 40% to about 60% of the height of stacking feet 8*a-d*, 10*a, b*. As shown in FIGS. 9 and 10, according to a preferred embodiment of the present invention, inner ribs 54 extend about 50% of the height of stacking feet 8*a-d*, and 10*a, b*. Therefore, according to a preferred embodiment of the present invention, the nesting ratio of pallet 100 is about 50%. Each stacking foot 8*a-d* and 10*a, b* has four inner ribs that originate from the bottom or stacking foot floor 34, and extend upwards. When an upper pallet 100' is stacked upon lower pallet 100, as shown in FIGS. 11 and 12 (FIG. 11 illustrates a front partial view of an upper pallet 100 nested within a lower similar pallet 100 according to an embodiment of the present invention, wherein the partial view of the upper and lower pallets 100', 100 is taken along line C-C of pallet 100 shown in FIG. 5, and FIG. 12 illustrates a partial side view of an upper pallet 100' nested within a lower similar pallet 100 according to an embodiment of the present invention, wherein the partial view of the upper and lower pallets 100', 100 is taken along line B-B of pallet 100 shown in FIG. 5), stacking foot floor 34' of upper pallet 100 rests upon an upper ledge 66 of inner ribs 54 of lower pallet 100. Note that as shown in FIGS. 11 and 12, an outer portion of stacking feet walls 32' of upper pallet 100' do not come into contact, other than incidentally, with an inner portion of stacking feet walls 32 of lower pallet 100. The designed height of inner ribs 54 prevents stacking feet 8*a-d'*, 10*a, b'* from entering in too deeply into outer stacking feet recess areas 46*a-d*, and inner stacking feet recess areas 48 of lower pallet 100. An exemplary embodiment of outer stacking feet recess area 46*b* is shown in FIG. 8. As shown in FIG. 12, in an alternate embodiment one of the inner ribs 54' can start from the same bottom point as other, adjacent inner ribs, and extend to a greater height than those adjacent ribs.

In regard specifically to outer stacking feet 8*a-d*, and outer stacking feet recess areas 46*a-d*, and their respective inner ribs 54, attention is directed towards FIG. 11, which shows that outer stacking feet 8*a-d* comprise an angled portion 30*a-d* (described in greater detail below) and inner ribs 54 are proportionately adjusted in height for the angled portion 30*a-d*. As shown in FIG. 11, inner ribs 54*a, b*, formed over angled portion 30*b* of lower pallet 100, rise to meet angled portion 30*b'* of upper pallet 100'. The effect of stacking foot 8*b'* of upper pallet 100' resting on inner ribs 54*a, b* of stacking foot 8*b* of lower pallet 100 is such that should stacked pallets be subjected to some kind of load, upper pallet 100' would be sufficiently supported by lower pallet 100, and the weight placed upon upper pallet 100' would be distributed evenly about lower pallet 100. If inner ribs 54*a, b* were not designed and implemented as shown, then it would be possible that a bending moment could be developed at the outer edges of upper pallet 100', which, even though of small magnitude, could over time lead to premature failure.

3. Angled Surfaces.

Figure 18:
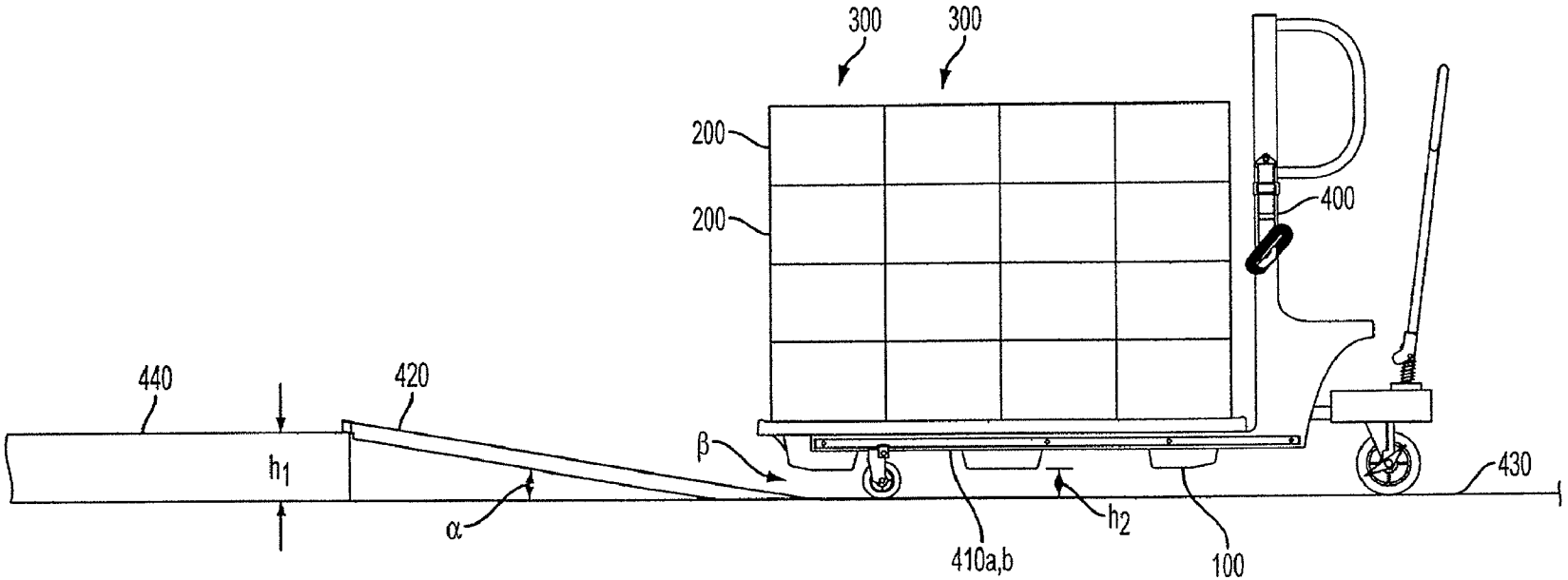
FIG. 18 illustrates delivery of a pallet loaded with beverage bottles from a first surface to a second surface using a ramp according to an embodiment of the present invention.
Figure 19:
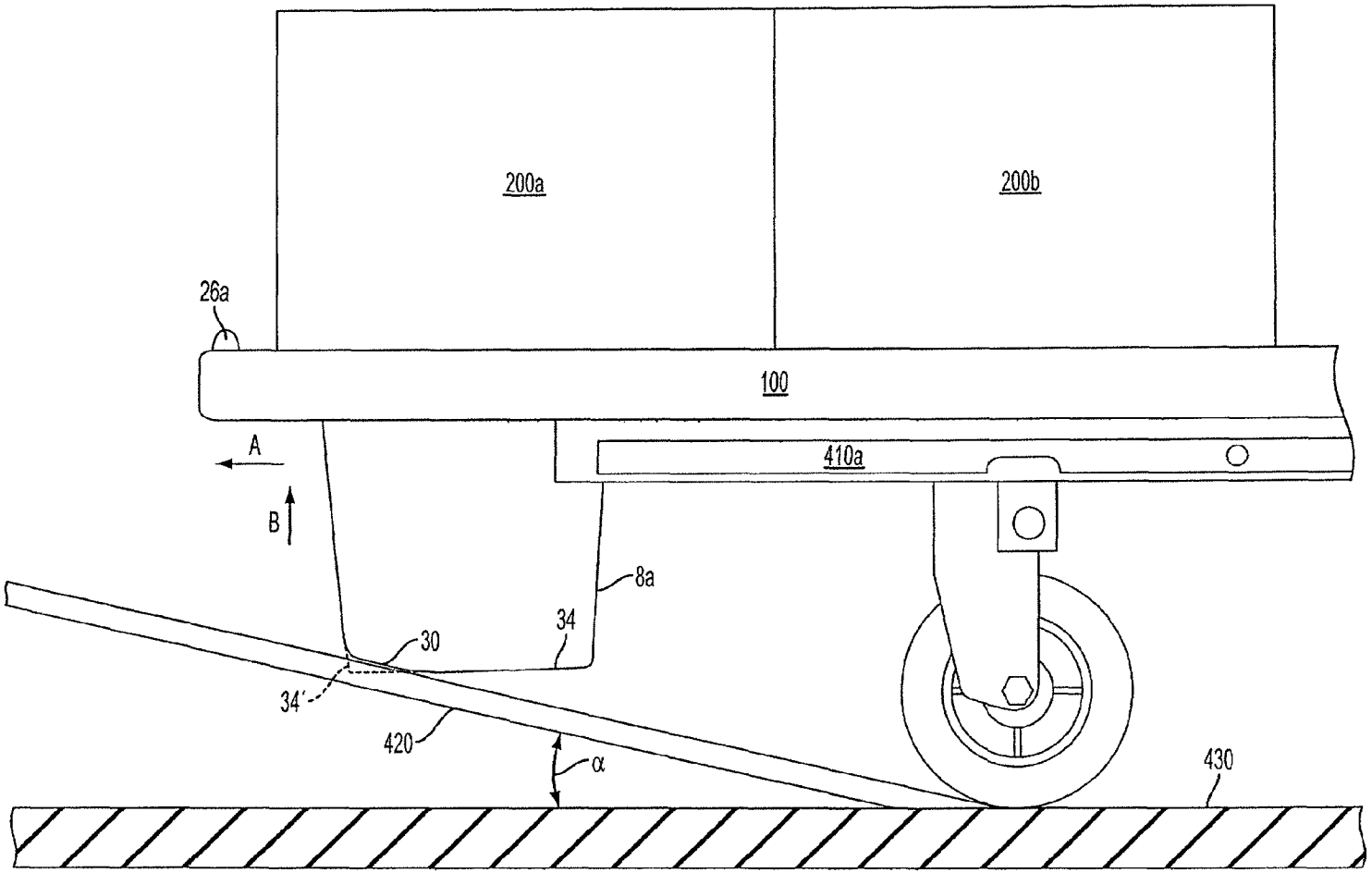
FIG. 19 illustrates a close-up view of a loaded pallet approaching a ramp to deliver beverage bottles to a retail location according to an embodiment of the present invention.

Referring now to FIGS. 3 and 4, stacking feet angled surface (angled surface) 30 are shown on outer stacking feet 8*a-d*. Angled surface 30 is formed from stacking feet floor 34 at angle β (shown in FIG. 3) between about 10° and 20°. According to an exemplary embodiment of the present invention, β is preferably about 15°. FIG. 18 and FIG. 19 illustrates the use of angled portion 34. FIG. 18 illustrates a user delivering pallets 100 loaded with beverage trays 200 and beverage bottles 300 with a pallet jack 400. To go from first surface 430 to second surface 440, the user places ramp 420 between the two. Referring now to FIG. 19, which is a close-up view of stacking foot 8*a*, as front wheel 450 of pallet jack 400 encounters ramp 420, stacking foot 8*a* is just approaching ramp 420. If stacking foot 8*a* were shaped to include stacking foot floor 34', as the dotted lines indicate, it would hit ramp 420 which would then impede the traversal of ramp 420 by the user. Instead, because of angled surface 30, stacking foot 8*a* (and 8*d*) do not impede the progress of the ramp of loaded pallet 100, and the user can easily deliver beverage bottles 300 to the retail location. As those of ordinary skill in the art of the present invention can appreciate, ramp 420 is an industry standard ramp, as is height $h_1$, and angle of incline α. Angle of incline a is between about 10° and 20°, and according to a preferred embodiment of the present invention, angle of incline α is 15°. First surface 430 is preferably a street surface, and second surface 440 is preferably a sidewalk, or a store floor near an entrance. Angled surface 30, preferably formed at an angle β of about 15°, is a preferred embodiment because of the parameters of the aforementioned ramp and curb height $h_1$.

Generally, it will be the case, as shown in the accompanying and just described FIGS. 18 and 19, that first surface 430 is lower relative to second surface 440 (see FIG. 18). That is, an operator will transit ramp 420 from the lower parking lot first surface 430 to the higher (relative to first surface 430) curb second surface 440. But that will not always be the case. It should be therefore understood by those of ordinary skill in the art of the present invention that angled surfaces 30 on stacking feet 8*a-d* work equally as well as described above if pallet 100 transits ramp 420 from a higher to lower surface. As long as the same approximate dimensions and configurations are observed, in the case when transiting ramp 420 from a higher first surface 430 to a lower second surface 440, pallet 100 will enable the operator to transit ramp 420 with little or no difficulty.

Also shown in FIG. 18 is height $h_2$ of loaded pallet 100. Height $h_2$ is the minimum height loaded pallet 100 needs to be raised without contacting ramp 420 while being transported from first surface 430 to second surface 440. As those of ordinary skill in the art can appreciate, the lower height $h_2$ is, the safer transportation of loaded pallet 100 is because the center of gravity (COG) is lower. According to a preferred embodiment of the present invention, without angled surfaces 30*a-d*, the minimum height of $h_2$ would be between about 5" to about 6", whereas, because of angled surfaces 30*a-d* of outer stacking feet 8*a-d*, the minimum height $h_2$ pallet 100 needs to be raised to clear ramp 420 is about 3½", which is a decrease of the COG of about 46%. A decrease in the height of the COG of pallet 100 of about 46% carrying about 1,000 lbs of beverages is a significant safety improvement. Additionally, because the COG of the loaded pallet 100 is lower through use of angled surfaces 30*a-d*, straps which would secure loaded pallet 100 to pallet jack 400, can be safely omitted.

Furthermore, the preferred angle β of about 15° optimizes the height pallet 100 has to be raised to avoid interference with ramp 420. If angle β were a significantly greater value, say about 45°, then outer stacking feet 8*a-d* would have to be made significantly larger, and if, as discussed above, angle β were reduced to 0°, then loaded pallet 100 would have to be raised significantly higher than about 3½", raising the COG of the loaded pallet, and necessitating the use of straps to retain the loaded pallet to pallet jack 400. Use of straps with pallet jack 400 significantly reduces the efficiency of delivery of the beverages, thereby increasing attendant costs.

4. Location of Stacking Feet.

According to a preferred embodiment of the present invention, outer stacking feet 8*a-d* and inner stacking feet 10*a, b*, as shown in FIGS. 2, 6, and 7, are arranged symmetrically about central longitudinal axis A-A and orthogonal axis B-B. That is, according to a preferred embodiment of the present invention, outer stacking foot 8*a* is located opposite outer stacking foot 8*d* across central longitudinal axis A-A along left side wall 24, and outer stacking foot 8*b* is located opposite outer stacking foot 8*c* across central longitudinal axis A-A along right side wall 20. Inner stacking feet 10*a* is located opposite inner stacking foot 10*b* across central longitudinal axis A-A, but are centrally located upon orthogonal axis B-B, as shown in FIGS. 2 and 3.

The location of both inner and outer stacking feet 10*a, b* and 8*a-d* about central longitudinal axis A-A provides an additional benefit in the stability and hence safety of pallet 100. According to a preferred embodiment of the present invention, outer stacking feet walls 32 of all stacking feet 8*a-d*, 10*a, b*, are defined as those walls of each stacking foot that are closest in proximity to rear side wall 22 for outer stacking feet 8*c, d*, and inner stacking feet 10*b*, and those walls of each stacking foot that is closest in proximity to front side wall 18 for outer stacking feet 8*a, b*, and inner stacking feet 10*a*. According to a preferred embodiment of the present invention, outer stacking foot walls 32 of outer and inner stacking feet 8*a-d*, 10*a, b*, are located a distance $d_1$ from their respective closest side walls as shown in FIG. 6. Distance $d_1$ is optimized to allow just enough room for placement of tines 410*a, b* of pallet jack 400 along side outer and inner stacking feet 8*a-d*, 10*a, b*. Placement of tines 410*a, b* of pallet jack 400 outside stacking feet 8*a-d*, 10*a, b* provides a significantly more stable lifting platform than if the tines 410*a, b* were inside the outer and inner stacking feet 8*a-d*, 10*a, b*. As one of ordinary skill in the art can appreciate, locating tines 410*a, b* closer to the central longitudinal axis A-A makes a loaded pallet 100 more unstable.

III. Method of Using Pallet

According to a further exemplary embodiment of the present invention, the various inventive features described herein provide for an efficient and effective means for transporting pallets 100 loaded with beverage trays 200 and beverage bottles 300 from a delivery vehicle to a retail location for display and purchase by consumers.

Figure 13:
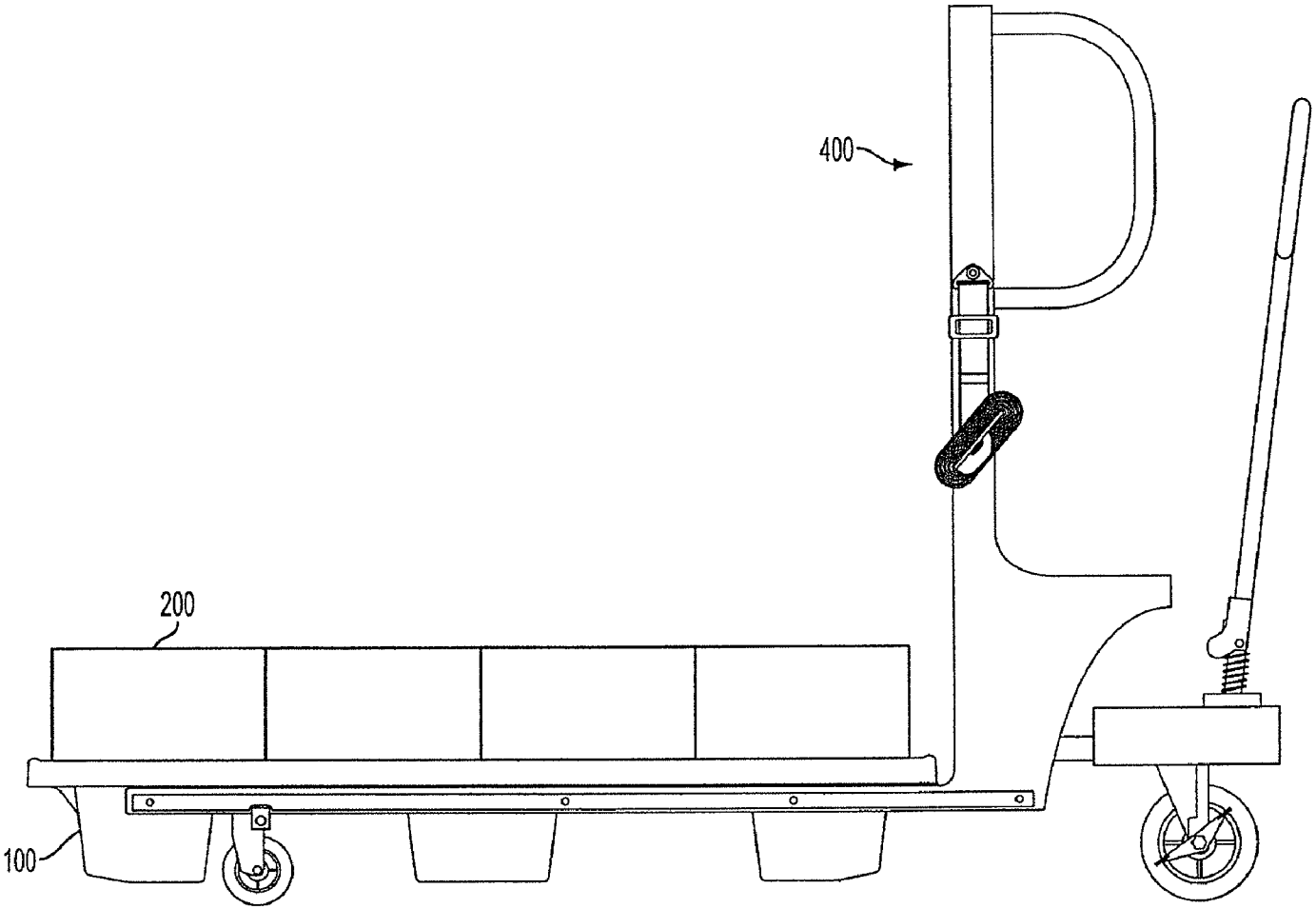
FIG. 13 illustrates a left side view of a pallet jack loaded with the pallet shown in FIG. 2 according to an embodiment of the present invention.
Figure 14:
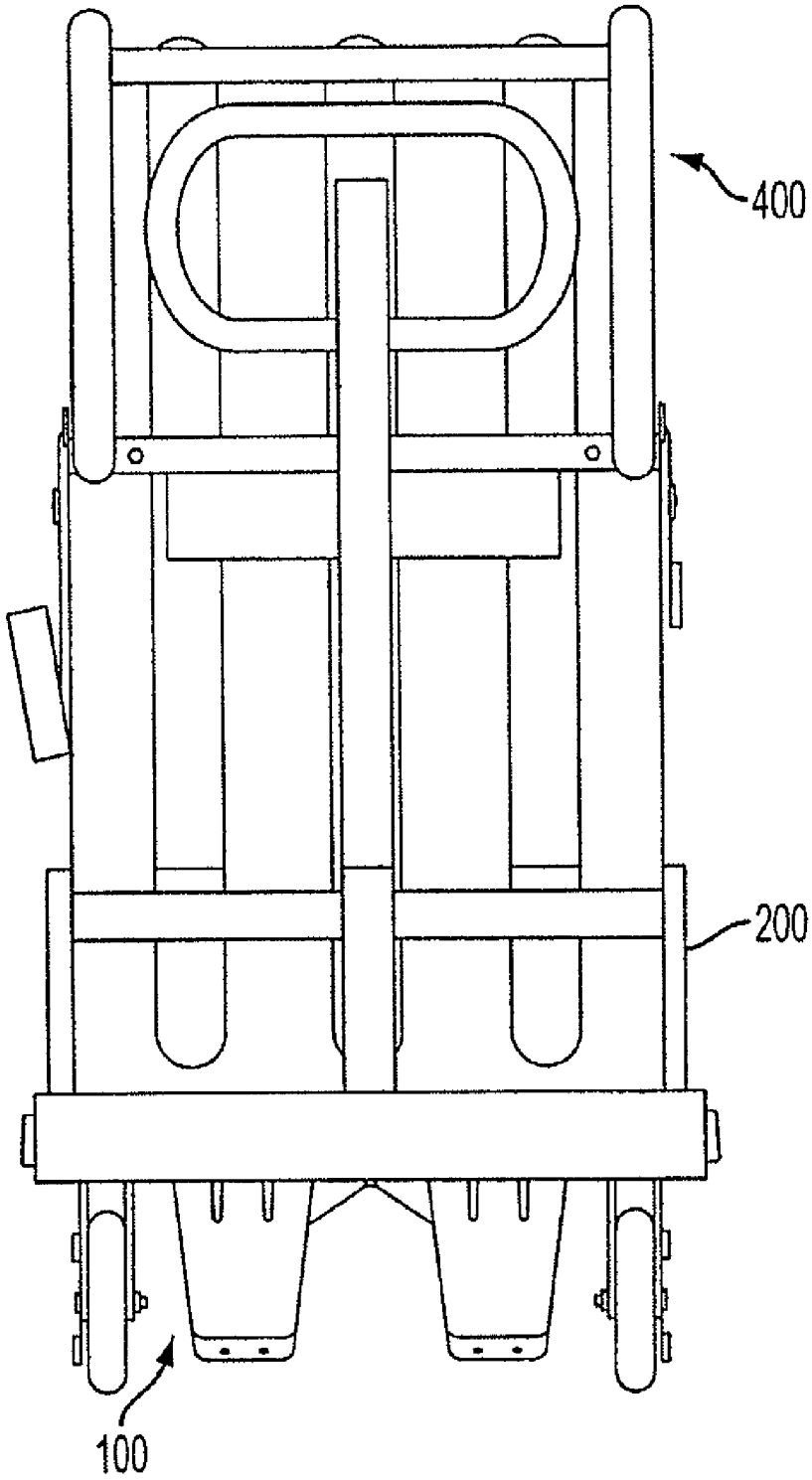
FIG. 14 illustrates a front view of a pallet jack loaded with the pallet shown in FIG. 2 according to an embodiment of the present invention.
Figure 15:
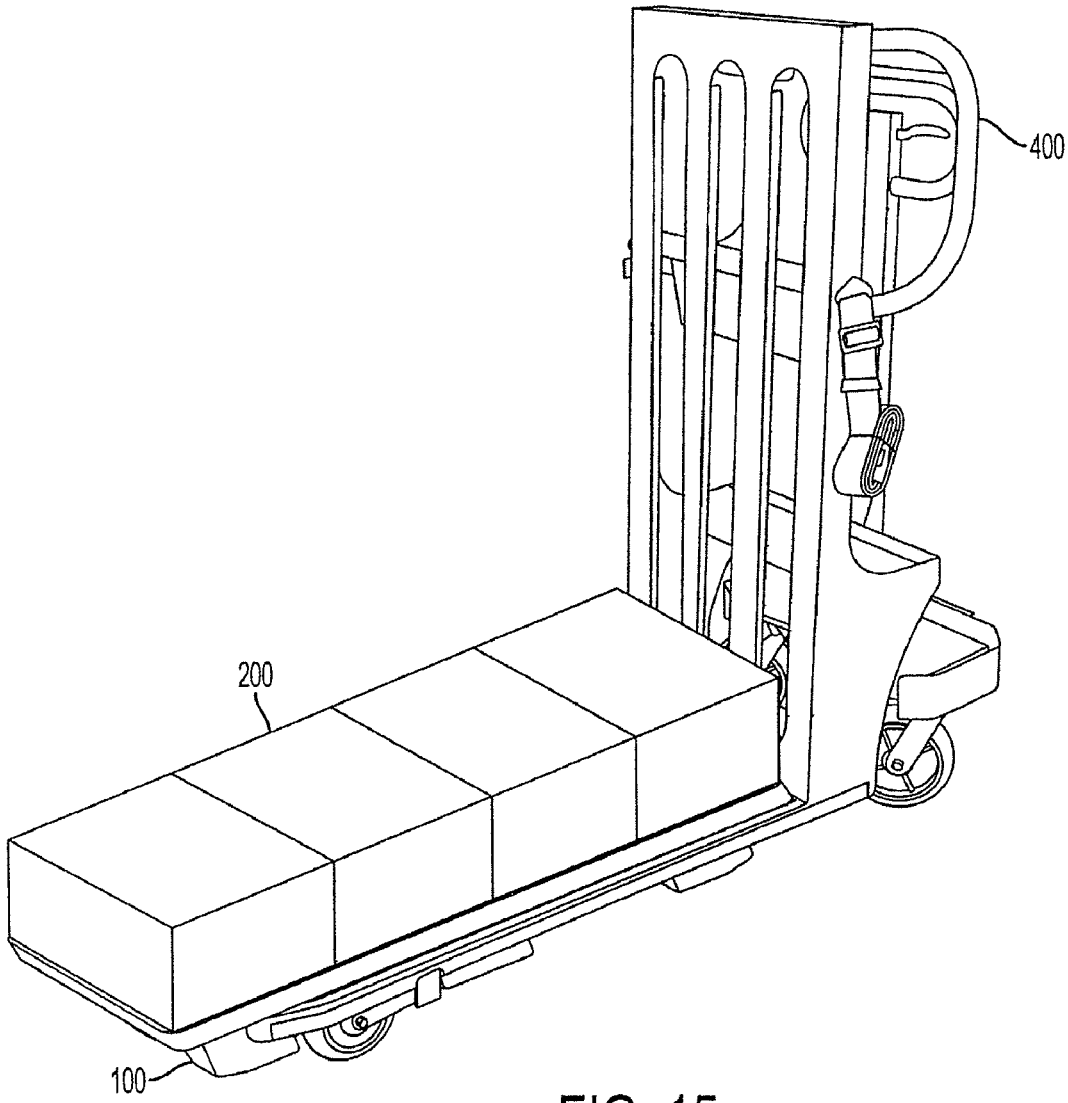
FIG. 15 illustrates a front isometric view of a pallet jack loaded with the pallet shown in FIG. 2 according to an embodiment of the present invention.

According to an exemplary embodiment of the present invention, the method for transporting beverage trays 200 loaded onto pallet 100 from a delivery vehicle to a retail location begins with the loading of beverage trays 200 onto pallet 100. FIGS. 12-14 illustrate pallet jack 400 loaded with partially loaded pallet 100 from a left side view, right side view and from isometric view, respectively, according to exemplary embodiments of the present invention. According to an exemplary embodiment of the present invention, pallets 100 are usually filled with beverage bottles 300 at a central warehouse or shipping distribution center (and covered with plastic film (i.e., "shrink-wrapped)), although it may be the case that pallets 100 can also be loaded with beverage bottles 300 directly from the delivery vehicle. Once pallets 100 are loaded with beverage trays 200 that are filled with beverage bottles 300, pallet jack 400, comprising a plurality of tines 410*a, b*, is located adjacent the loaded pallet 100, and tines 410*a, b* are located alongside an outer portion of each of the plurality stacking feet as described above. Loaded pallet 100 is then lifted by pallet jack 400 and transported from the delivery vehicle to first surface 430. Loaded pallet 100 needs only be lifted to a height $h_2$ that, according to an exemplary embodiment of the present invention, is about 3½". Further, because loaded pallet 100 is only lifted to height $h_2$, and not a significantly greater height, straps that are typically used to retain loaded beverage containers to pallet jack 400 do not typically have to be used, although in some circumstances they will be used.

Pallet jack 400 then transports loaded pallet 100 from first surface 430 to second surface 440 using ramp 420. During the transporting of loaded pallet 100, pallet 100 traverses ramp 420 inclined at a first angle α from first surface 430 to second surface 440 without substantial impedance as a result of angled surfaces 30*a-d* on outer stacking feet 8*a-d*. Following passage of loaded pallet 100 up ramp 420 to second surface 440, the user of pallet jack 400 and pallet 100 places loaded pallet 100 into a preferred location in the retail store wherein the user lowers loaded pallet 100 into place, removes pallet jack 400 from under loaded pallet 100, and consumers can then purchase beverage bottles. According to a further exemplary embodiment of the present invention, the method further comprises wrapping loaded pallet 100 with a shrink wrap material, which substantially prevents displacement of beverage trays 200 and beverage bottles 300 during shipment of the same (especially if previously loaded onto pallet 100 at a distribution center), and the user or retail store owner must then remove the shrink wrap material prior to purchase by consumers. As discussed above, angled surfaces 30*a-d* on outer stacking feet 8*a-d* enable transport of pallet 100 with little or no interference when traversing ramp 420 from a higher first surface 430 to a lower second surface 440. In this case, however, the angled surfaces 30*a-d* do not interfere with the lower second surface 440 as pallet 400 with pallet 100 transitions from ramp 420 to lower second surface 440. Furthermore, according to additional exemplary embodiments of the present invention, pallet 100 can be loaded with virtually any type of packaged goods.

The present invention has been described with reference to certain exemplary embodiments thereof. However, it will be readily apparent to those skilled in the art that it is possible to embody the invention in specific forms other than those of the exemplary embodiments described above. This may be done without departing from the spirit and scope of the invention. The exemplary embodiments are merely illustrative and should not be considered restrictive in any way. The scope of the invention is defined by the appended claims and their equivalents, rather than by the preceding description.

All United States patents and applications, foreign patents, and publications discussed above are hereby incorporated herein by reference in their entireties into the detailed description portion of the specification.

What is claimed is:

1. A pallet for use in transporting packaged goods, comprising:

a front side wall, a right side wall, a rear side wall and a left side wall, the pallet having a central longitudinal axis running from the left side wall to the right side wall;

a base configured to support the packaged goods, the base being joined to each of the front side wall, right side wall, rear side wall, and left side wall such that each side wall is orthogonal to the base, the base including an upper surface and a lower surface, the upper surface being substantially planar, and the lower surface including a first set of ribs substantially perpendicular and adjacent to the central longitudinal axis of the pallet, wherein the first set of ribs includes a plurality of substantially V-shaped ribs, and further wherein each of the substantially V-shaped ribs forms an inverted V-shaped angle; and a plurality of pairs of stacking feet configured to support the base of the pallet, wherein each stacking foot in each pair of stacking feet is substantially equidistant from the central longitudinal axis of the pallet, wherein each rib in the first set of ribs is configured to join a respective pair of stacking feet together to substantially inhibit the respective pair of stacking feet from spreading when the pallet rests upon the stacking feet, and wherein each stacking foot has a plurality of interior ribs each directly contacting an interior surface thereof and configured to support a bottom of an upper nested like pallet, at least one of said interior ribs in at least one of the stacking feet having a top that is vertically higher than the top of an adjacent interior rib, where the bottoms of said at least one interior rib and said adjacent interior rib are in the same horizontal plane, each of the plurality of interior ribs being configured such that outer walls of the stacking feet of the upper nested pallet do not come into contact with inner walls of the stacking feet of the lower pallet.

2. The pallet according to claim 1, wherein for each pair of stacking feet, a first stacking foot is located on a first side of the central longitudinal axis, and a second stacking foot is located on a second side of the central longitudinal axis, and wherein the first stacking foot and the second stacking foot are each located substantially equi-distant from the central longitudinal axis of the pallet.

3. The pallet according to claim 1, wherein the V-shaped angle formed by each of the substantially V-shaped ribs measures between about 70° and about 110°.

4. The pallet according to claim 1, wherein the V-shaped angle formed by each of the substantially V-shaped ribs measures between about 80° and about 100°.

5. The pallet according to claim 1, wherein the V-shaped angle formed by each of the substantially V-shaped ribs measures about 90°.

6. The pallet according to claim 1, wherein the plurality of pairs of stacking feet comprises three pairs of stacking feet.

7. The pallet according to claim 1, further comprising:

a plurality of handles configured to enable a user to grasp the pallet, wherein each of the handles is positioned on the base, and wherein each of the plurality of handles includes a opening through the base of the pallet.

8. The pallet according to claim 7, wherein the plurality of handles comprises:

a left side wall handle located adjacent to the left side wall and wherein the left side wall handle is substantially symmetrically placed about the central longitudinal axis;

a right side wall handle located adjacent to the right side wall and wherein the right side wall handle is substantially symmetrically placed about the central longitudinal axis;

a pair of front side wall handles located adjacent to the front side wall; and a pair of rear side wall handles located adjacent to the rear side wall, wherein, each handle in each of the pair of front side wall handles and rear side wall handles are located substantially equidistant from an orthogonal longitudinal axis, wherein, the orthogonal longitudinal axis is substantially perpendicular to the central longitudinal axis, and is substantially equidistant from the left side wall and the right side wall.

9. The pallet according to claim 8, wherein, each of the left side wall handles and the right side wall handles comprises:

a plurality of handle strengthening ribs configured to strengthen the left side wall and right side wall respectively, wherein each of the plurality of handle strengthening ribs are located on an outer wall of the side walls.

10. The pallet according to claim 8, wherein each of the left side wall handles and right side wall handle handles comprises:

a plurality of finger recesses located on the left side wall and right side wall, respectively.

11. The pallet according to claim 1, further comprising:

a left ledge located on the upper surface of the base over the left side wall; and a right ledge located on the upper surface of the base over the right side wall, wherein the right ledge and the left ledge are configured to substantially prevent one or more of the packaged goods from sliding off the pallet.

12. The pallet according to claim 11, wherein each of the left ledge and the right ledge comprises:

a raised portion of the upper surface of the base in a semicircular shape with a radius between about 0.120 and about 0.6 inches.

13. The pallet according to claim 11, wherein each of the left ledge and the right ledge comprises:

a raised portion of the upper surface of the base in a semicircular shape with a radius of about 0.5 inches.

14. The pallet according to claim 1, further comprising:

one or more recesses located on the upper surface of the base; and a tacky material positioned within the one or more recesses, wherein the tacky material is configured to substantially prevent one or more of the packaged goods from sliding off the pallet.

15. A pallet for use in transporting packaged goods, comprising:

a front side wall, a right side wall, a rear side wall and a left side wall, the pallet having a central longitudinal axis running from the left side wall to the right side wall;

a base configured to support the packaged goods, the base being joined to each of the front side wall, right side wall, rear side wall, and left side wall such that each side wall is orthogonal to the base, the base including an upper surface and a lower surface, the upper surface being substantially planar, and the lower surface including a first set of ribs substantially perpendicular and adjacent to the central longitudinal axis of the pallet; and a plurality of pairs of stacking feet configured to support the base of the pallet, wherein a first pair of stacking feet are located adjacent the left side wall, a second pair of stacking feet are located adjacent the right side wall, and a third pair of stacking feet are located between the first pair of stacking feet and second pair of stacking feet, and wherein each of the stacking feet in the first pair of stacking feet includes a substantially horizontal floor portion and an angled portion originating from the substantially horizontal floor portion, and wherein, the angled portion is formed at an angle in the range of about 10° to about 20° with respect to a plane of the substantially horizontal portion of the first pair of stacking feet, such that a plane of the angled portion of the first pair of stacking feet intersects a plane of the base of the pallet, and further wherein each of the stacking feet in the second pair of stacking feet includes a substantially horizontal floor portion and an angled portion originating from the substantially horizontal floor portion, wherein the angled portion is formed at an angle in the range of about 10° to about 20° with respect to a plane of the substantially horizontal portion of the second pair of stacking feet, such that a plane of the angled portion of the second pair of stacking feet intersects a plane of the base of the pallet, and further wherein, the angled portions of each of the first pair of stacking feet and second stacking feet are configured to enable the pallet to be transported over an inclined ramp without substantially interfering with the inclined ramp, and wherein each stacking foot has a plurality of interior ribs each directly contacting an interior surface thereof and configured to support a bottom of an upper nested like pallet, at least one of said interior ribs in at least one of the stacking feet having a top that is vertically higher than the top of an adjacent interior rib, where the bottoms of said at least one interior rib and said adjacent interior rib are in the same horizontal plane, each of the plurality of interior ribs being configured such that outer walls of the stacking feet of the upper nested pallet do not come into contact with inner walls of the stacking feet of the lower pallet.

16. The pallet according to claim 15, wherein the angled portion of both the first pair of stacking feet and second pair of stacking feet is formed at an angle of about 15°.

17. The pallet according to claim 15, further comprising:

a plurality of handles configured to enable a user to grasp the pallet, wherein each of the handles is positioned on the base, and wherein each of the plurality of handles includes a opening through the base of the pallet.

18. The pallet according to claim 17, wherein the plurality of handles comprises:

a left side wall handle located adjacent to the left side wall and wherein the left side wall handle is substantially symmetrically placed about the central longitudinal axis;

a right side wall handle located adjacent to the right side wall and wherein the right side wall handle is substantially symmetrically placed about the central longitudinal axis;

a pair of front side wall handles located adjacent to the front side wall; and a pair of rear side wall handles located adjacent to the rear side wall, wherein each handle in each of the pair of front side wall handles and rear side wall handles are located substantially equidistant from an orthogonal longitudinal axis, wherein the orthogonal longitudinal axis is substantially perpendicular to the central longitudinal axis, and is substantially equidistant from the left side wall and the right side wall.

19. The pallet according to claim 18, wherein, each of the left side wall handles and the right side wall handles comprises:

a plurality of handle strengthening ribs configured to strengthen the left side wall and right side wall respectively, wherein each of the plurality of handle strengthening ribs are located on an outer wall of the side walls.

20. The pallet according to claim 18, wherein each of the left side wall handles and right side wall handle handles comprises:

a plurality of finger recesses located on the left side wall and right side wall, respectively.

21. The pallet according to claim 15, further comprising:

a left ledge located on the upper surface of the base over the left side wall; and a right ledge located on the upper surface of the base over the right side wall, wherein, the right ledge and the left ledge are configured to substantially prevent one or more of the packaged goods from sliding off the pallet.

22. The pallet according to claim 21, wherein each of the left ledge and the right ledge comprises:

a raised portion of the upper surface of the base in a semicircular shape with a radius between about 0.120 and about 0.6 inches.

23. The pallet according to claim 21, wherein each of the left ledge and the right ledge comprises:

a raised portion of the upper surface of the base in a semicircular shape with a radius of about 0.5 inches.

24. The pallet according to claim 15, further comprising:

one or more recesses located on the upper surface of the base; and a tacky material positioned within the one or more recesses, wherein the tacky material is configured to substantially prevent one or more of the packaged goods from sliding off the pallet.

25. A pallet for use in transporting packaged goods, comprising:

a front side wall, a right side wall, a rear side wall and a left side wall, the pallet having a central longitudinal axis running from the left side wall to the right side wall;

a base configured to support the packaged goods, the base being joined to each of the front side wall, right side wall, rear side wall, and left side wall such that each side wall is orthogonal to the base, the base including an upper surface and a lower surface, the upper surface being substantially planar, and the lower surface including a first set of ribs substantially perpendicular and adjacent to the central longitudinal axis of the pallet; and a plurality of pairs of stacking feet configured to support the base of the pallet, wherein each stacking foot in each pair of stacking feet is substantially equidistant from the central longitudinal axis of the pallet, thereby forming a set of front side wall stacking feet and a set of rear side wall stacking feet, and further wherein the set of front side wall stacking feet are located at a predetermined distance from the front side wall, and the set of rear side wall stacking feet are located at a predetermined distance from the rear side wall, such that a first tine from a lifting device can be located adjacent the set of front side wall stacking feet, and a second tine from a lifting device can be located adjacent the set of rear side wall stacking feet, such that each of the first tine and the second tine is substantially parallel to the central longitudinal axis of the pallet, thereby further enabling the pallet to be lifted by the first and second tines, and wherein each stacking foot has a plurality of interior ribs each directly contacting an interior surface thereof and configured to support a bottom of an upper nested like pallet, at least one of said interior ribs in at least one of the stacking feet having a top that is vertically higher than the top of an adjacent interior rib, where the bottoms of said at least one interior rib and said adjacent interior rib are in the same horizontal plane, each of the plurality of interior ribs being configured such that outer walls of the stacking feet of the upper nested pallet do not come into contact with inner walls of the stacking feet of the lower pallet.

26. The pallet according to claim 25, further comprising:

a plurality of handles configured to enable a user to grasp the pallet, wherein each of the handles is positioned on the base, and wherein each of the plurality of handles includes a opening through the base of the pallet.

27. The pallet according to claim 26, wherein the plurality of handles comprises:

a left side wall handle located adjacent to the left side wall and wherein the left side wall handle is substantially symmetrically placed about the central longitudinal axis;

a right side wall handle located adjacent to the right side wall and wherein the right side wall handle is substantially symmetrically placed about the central longitudinal axis;

a pair of front side wall handles located adjacent to the front side wall; and a pair of rear side wall handles located adjacent to the rear side wall, wherein, each handle in each of the pair of front side wall handles and rear side wall handles are located substantially equidistant from an orthogonal longitudinal axis, wherein, the orthogonal longitudinal axis is substantially perpendicular to the central longitudinal axis, and is substantially equidistant from the left side wall and the right side wall.

28. The pallet according to claim 27, wherein, each of the left side wall handles and the right side wall handles comprises:

a plurality of handle strengthening ribs configured to strengthen the left side wall and right side wall respectively, wherein each of the plurality of handle strengthening ribs are located on an outer wall of the side walls.

29. The pallet according to claim 27, wherein each of the left side wall handles and right side wall handles comprises:

a plurality of finger recesses located on the left side wall and right side wall, respectively.

30. The pallet according to claim 25, further comprising:

a left ledge located on the upper surface of the base over the left side wall; and a right ledge located on the upper surface of the base over the right side wall, wherein, the right ledge and the left ledge are configured to substantially prevent one or more of the packaged goods from sliding off the pallet.

31. The pallet according to claim 30, wherein each of the left ledge and the right ledge comprises:

a raised portion of the upper surface of the base in a semicircular shape with a radius between about 0.120 and about 0.6 inches.

32. The pallet according to claim 31, wherein each of the left ledge and the right ledge comprises:

a raised portion of the upper surface of the base in a semicircular shape with a radius of about 0.5 inches.

33. The pallet according to claim 25, further comprising:

one or more recesses located on the upper surface of the base; and a tacky material positioned within the one or more recesses, wherein the tacky material is configured to substantially prevent one or more of the packaged goods from sliding off the pallet.

34. A pallet for use in transporting packaged goods, comprising:

a front side wall, a right side wall, a rear side wall and a left side wall, the pallet having a central longitudinal axis running from the left side wall to the right side wall;

a base configured to support the packaged goods, the base being joined to each of the front side wall, right side wall, rear side wall, and left side wall such that each side wall is orthogonal to the base;

a plurality of pairs of stacking feet configured to support the base of the pallet, wherein each stacking foot in each pair of stacking feet is substantially equidistant from the central longitudinal axis of the pallet, and further wherein, the base including an upper surface and a lower surface, the upper surface being substantially planar, and the lower surface including a first set of ribs substantially perpendicular and adjacent to the central longitudinal axis of the pallet, a second set of ribs located within an area defined by an outer perimeter of the plurality of pairs of stacking feet but not where the first set of ribs are located, and a third set of ribs located outside the area of the first and second set of ribs, wherein each of the ribs of the first and second set of ribs are taller than each of the ribs of the third set of ribs, and wherein each stacking foot has a plurality of interior ribs each directly contacting an interior surface thereof and configured to support a bottom of an upper nested like pallet, at least one of said interior ribs in at least one of the stacking feet having a top that is vertically higher than the top of an adjacent interior rib, where the bottoms of said at least one interior rib and said adjacent interior rib are in the same horizontal plane, each of the plurality of interior ribs being configured such that outer walls of the stacking feet of the upper nested pallet do not come into contact with inner walls of the stacking feet of the lower pallet.

35. The pallet according to claim 34, wherein, the each of the ribs of the first and second set of ribs is configured to support more weight than if each of the ribs of the first and second ribs were about the same lower height as the third set of ribs.

36. The pallet according to claim 34, further comprising:

a plurality of handles configured to enable a user to grasp the pallet, wherein each of the handles is positioned on the base, and wherein each of the plurality of handles includes a opening through the base of the pallet.

37. The pallet according to claim 36, wherein the plurality of handles comprises:

a left side wall handle located adjacent to the left side wall and wherein the left side wall handle is substantially symmetrically placed about the central longitudinal axis;

a right side wall handle located adjacent to the right side wall and wherein the right side wall handle is substantially symmetrically placed about the central longitudinal axis;

a pair of front side wall handles located adjacent to the front side wall; and a pair of rear side wall handles located adjacent to the rear side wall, wherein, each handle in each of the pair of front side wall handles and rear side wall handles are located substantially equidistant from an orthogonal longitudinal axis, wherein the orthogonal longitudinal axis is substantially perpendicular to the central longitudinal axis, and is substantially equidistant from the left side wall and the right side wall.

38. The pallet according to claim 37, wherein, each of the left side wall handles and the right side wall handles comprises:

a plurality of handle strengthening ribs configured to strengthen the left side wall and right side wall respectively, wherein each of the plurality of handle strengthening ribs are located on an outer wall of the side walls.

39. The pallet according to claim 37, wherein each of the left side wall handles and right side wall handle handles comprises:

a plurality of finger recesses located on the left side wall and right side wall, respectively.

40. The pallet according to claim 34, further comprising:

a left ledge located on the upper surface of the base over the left side wall; and a right ledge located on the upper surface of the base over the right side wall, wherein the right ledge and the left ledge are configured to substantially prevent one or more of the packaged goods from sliding off the pallet.

41. The pallet according to claim 40, wherein each of the left ledge and the right ledge comprises:

a raised portion of the upper surface of the base in a semicircular shape with a radius between about 0.120 and about 0.6 inches.

42. The pallet according to claim 40, wherein each of the left ledge and the right ledge comprises:

a raised portion of the upper surface of the base in a semicircular shape with a radius of about 0.5 inches.

43. A method for transporting packaged goods on a pallet from a first location to a second location, the pallet comprising a base, the base including an upper surface and a lower surface, the pallet further comprising a front side wall, a right side wall, a rear side wall, and a left side wall, the pallet further comprising a plurality of handles and a plurality of stacking feet, the pallet having a central longitudinal axis running between the left side wall and the right side wall, and wherein each of the plurality of stacking feet is substantially equidistant from the central longitudinal axis, and wherein the plurality of stacking feet includes a first pair of stacking feet located adjacent to the left side wall of the pallet, and a second pair of stacking feet located adjacent the right side wall, and wherein, each stacking foot of the first and second pair of stacking feet includes an angled portion, and wherein each stacking foot has a plurality of interior ribs each directly contacting an interior surface thereof and configured to support a bottom of an upper nested like pallet, at least one of said interior ribs in at least one of the stacking feet having a top that is vertically higher than the top of an adjacent interior rib, each of the plurality of interior ribs being configured such that outer walls of the stacking feet of the upper nested pallet do not come into contact with inner walls of the stacking feet of said pallet, the method comprising:

loading the packaged goods onto the pallet;

stacking an upper pallet onto said pallet such that (i) the outer walls of the stacking feet of the upper pallet do not come into contact with the inner walls of the stacking feet of said pallet, (ii) the bottom of at least one stacking foot of the upper pallet rests on the at least one interior rib in said pallet which has the vertically higher top, and not on the top of the adjacent interior rib, and (iii) the bottoms of said at least one interior rib and said adjacent interior rib are in the same horizontal plane;

positioning a first tine of a lifting mechanism adjacent to the left side wall and substantially parallel to the central longitudinal axis and positioning a second tine of a lifting mechanism adjacent to the right side wall and substantially parallel to the central longitudinal axis;

lifting the loaded pallet using the lifting mechanism; and transporting the lifted loaded pallet from a first area to a second area by traversing an inclined ramp between the first and second areas, wherein the angled portions of the respective stacking feet enable the pallet to traverse the ramp in a substantially unimpeded manner.

44. The method according to claim 43, wherein the first area comprises a parking lot and the second area comprises one of a sidewalk and an interior floor of a retail store.

45. The method according to claim 43, wherein the step of positioning further comprises:

positioning the first tine of the lifting mechanism adjacent to an outer wall of each of the plurality of stacking feet located adjacent to the left side wall; and positioning the second tine of the lifting mechanism adjacent to an outer wall of each of the plurality of stacking feet located adjacent to the right side wall.

46. The method according to claim 43, wherein the step of loading further comprises:

wrapping a material around the loaded pallet such that the pallet and the packed goods are held substantially together by the wrapped material.

47. The method according to claim 46, wherein the wrapping material is a plastic material that shrinks when exposed to elevated temperatures.

48. The method according to claim 43, further comprising;

strapping the packaged goods loaded onto the pallet with a strap that is attached to the pallet jack.

49. The method according to claim 48 wherein the strap is a retractable strap.

50. A pallet for use in transporting packaged goods, comprising:

a front side wall, a right side wall, a rear side wall and a left side wall, the pallet having a central longitudinal axis running from the left side wall to the right side wall;

a base, the base being joined to each of the front side wall, right side wall, rear side wall, and left side wall such that each side wall is orthogonal to the base, the base including an upper surface and a lower surface, the upper surface being substantially planar, and the lower surface including a first set of ribs substantially perpendicular and adjacent to the central longitudinal axis of the pallet; and a plurality of pairs of stacking feet configured to support the base of the pallet, wherein each stacking foot in each pair of stacking feet is substantially equidistant from the central longitudinal axis of the pallet, and further wherein, each rib in the first set of ribs is configured to join a respective pair of stacking feet together to substantially inhibit the respective pair of stacking feet from spreading when the pallet rests upon the stacking feet, and wherein each stacking foot has a plurality of interior ribs each directly contacting an interior surface thereof and configured to support a bottom of an upper nested like pallet, at least one of said interior ribs in at least one of the stacking feet having a top that is vertically higher than the top of an adjacent interior rib, where the bottoms of said at least one interior rib and said adjacent interior rib are in the same horizontal plane, each of the plurality of interior ribs being configured such that outer walls of the stacking feet of the upper nested pallet do not come into contact with inner walls of the stacking feet of the lower pallet.

51. The pallet according to claim 50, wherein the pallet is configured to be placed in a retail environment.

52. The pallet according to claim 50, wherein the pallet is configured to be placed in a manufacturing environment.

* * * * *